US006165661A

United States Patent [19]

Hsiao et al.

[11] Patent Number: 6,165,661

[45] **Date of Patent: *Dec. 26, 2000**

[54] PERYLENE COMPOSITIONS

[75] Inventors: Cheng-Kuo Hsiao; Ah-Mee Hor; James M. Duff; Giuseppa Baranyi, all of Mississauga; C. Geoffrey Allen, Waterdown, all of Canada

[73] Assignee: Xerox Corporation, Stamford, Conn.

[ * ] Notice: This patent is subject to a terminal disclaimer.

[21] Appl. No.: 09/317,230

[22] Filed: May 21, 1999

[51] Int. Cl.[7] ..... G03G 15/045; G03G 5/047; G03G 5/06

[52] U.S. Cl. ..... 430/59; 430/78; 430/71; 430/56; 430/57; 546/34; 546/36; 546/37

[58] Field of Search ..... 546/34, 36, 37; 430/59, 78, 71, 56, 57

[56] References Cited

U.S. PATENT DOCUMENTS

| | | | |
|---|---|---|---|
| 4,265,990 | 5/1981 | Stolka et al. | 430/59 |
| 4,419,427 | 12/1983 | Graser et al. | 430/58 |
| 4,429,029 | 1/1984 | Hoffmann et al. | 430/57 |
| 4,469,769 | 9/1984 | Nakazawa et al. | 430/78 |
| 4,501,906 | 2/1985 | Spietschka et al. | 549/232 |
| 4,514,482 | 4/1985 | Loutfy et al. | 430/78 |
| 4,556,622 | 12/1985 | Neumann et al. | 430/58 |
| 4,709,029 | 11/1987 | Spietschka et al. | 544/125 |
| 4,714,666 | 12/1987 | Wiedemann et al. | 430/59 |
| 4,937,164 | 6/1990 | Duff et al. | 430/58 |
| 4,968,571 | 11/1990 | Gruenbaum et al. | 430/58 |
| 5,019,473 | 5/1991 | Nguyen et al. | 430/58 |
| 5,225,307 | 7/1993 | Hor et al. | 430/136 |
| 5,645,965 | 7/1997 | Duff et al. | 430/59 |
| 5,683,842 | 11/1997 | Duff et al. | 430/59 |
| 5,756,744 | 5/1998 | Duff et al. | 546/34 |

*Primary Examiner*—Alan L. Rotman
*Assistant Examiner*—Rita Desai
*Attorney, Agent, or Firm*—E. O. Palazzo

[57] ABSTRACT

A mixture comprised of at least two perylenes and wherein the mixture includes symmetrical perylenes, unsymmetrical perylenes, and unsymmetrical perylenes with dissimilar $R_1$ and $R_2$ terminal substituents. The perylene mixtures can be selected for photoconductive imaging members.

72 Claims, No Drawings

PERYLENE COMPOSITIONS

PENDING APPLICATIONS AND PATENTS

Illustrated in copending application 09/165,595, and U.S. Pat. No. 5,645,965, U.S. Pat. No. 5,683,842 and U.S. Pat. No. 5,756,744, the disclosures of which are totally incorporated herein by reference, are perylenes and photoconductive imaging members thereof.

Illustrated in copending application U.S. Ser. No. 09/316,587, the disclosure of which is totally incorporated herein by reference, and filed concurrently herewith, are phoconductive imaging members containing perylene compositions.

BACKGROUND OF THE INVENTION

The present invention is directed generally to perylenes, and more specifically, perylene mixtures, and which mixtures can be selected as photogenerating pigments for photoconducitve imaging members. The perylene compositions are in embodiments comprised of a mixture of at least two or more, for example from about 2 to about 10, and preferably from 2 to about 5 and more preferably 2, perylene bisimide dimers and wherein each dimer is essentially represented by Formulas 1, 2, and 3, reference U.S. Pat. Nos. 5,645,965; 5,683,842 and 5,756,744, the disclosures of which are totally incorporated herein by reference

FORMULA 1

Symmetrical Perylene Dimer

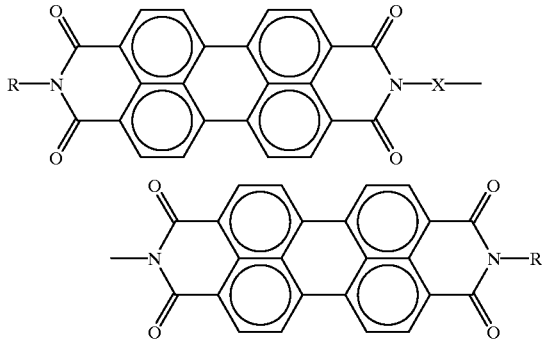

wherein R is, for example, hydrogen, alkyl, cycloalkyl, oxaalkyl, substituted alkyl, aryl, substituted aryl, aralkyl or arylalkyl, substituted aralkyl or arylalkyl, and the like, and each R is preferably the same substituent, and X is a symmetrical bridging moiety such as a single N—N bond when X is absent, and wherein X is more specifically a symmetrical group or X is $(X)_n$ wherein n represents the number of groups and n is zero or 1, for example, alkylene, substituted alkylene, cycloalkylene, arylene, substituted arylene, aralkylene, substituted aralkylene, and the like. Alkyl includes linear and branched components with for example, from 1 to about 25, and preferably from 2 to about 10 carbon atoms, such as methyl, ethyl, propyl, butyl, pentyl, heptyl, octyl, and decyl. Alkylene includes components with, for example, (for carbon chain lengths throughout it is intended to include the phrase "for example") from 1 to about 25, and preferably from 1 to about 10 carbon atoms, such as ethylene, trimethylene, tetramethylene, pentamethylene, hexamethylene, octamethylene, dodecamethylene, and the like. Alkylene can be substituted with known effective groups, such as alkyl, with from about 1 to about 25 carbon atoms, like methyl, ethyl, propyl, butyl, and the like, alkoxy with, for example, from about 1 to about 25 carbon atoms, such as methoxy, ethoxy, propoxy, butoxy and the like. Arylene includes components with from 6 to about 24 carbon atoms such as phenylenes, naphthylenes, and the like, and more specifically 1,3- and 1,4-phenylene, 1,4-, 1,5-, 1,6- and 2,7-naphthylenes, and the like, and which aryl can be substituted with, for example, alkyl, such as methyl, ethyl and the like. Aryl and the other substituents mentioned herein are known and also in embodiments are as more specifically illustrated herein, but not necessarily limited to such substituents.

FORMULA 2

Unsymmetrical Perylene Dimer with Unsymmetrical Bridge, Reference U.S. Pat. Nos. 5,683,842 and 5,756,744, the Disclosures of Which are Totally Incorporated Herein By Reference

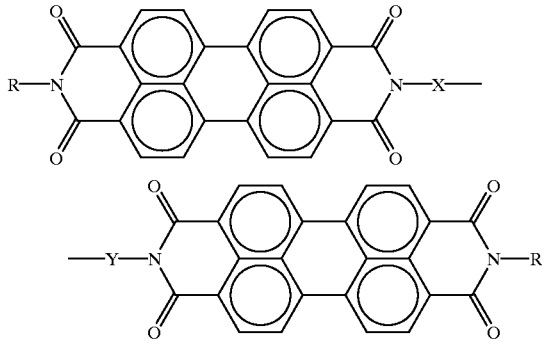

wherein R is, for example, hydrogen, alkyl, cycloalkyl, oxaalkyl, substituted alkyl, aryl, substituted aryl, aralkyl or arylalkyl, substituted aralkyl or arylalkyl, and the like, and wherein R and R are preferably the same substituent, and X-Y represents an unsymmetrical bridging moiety such as an unsymmetrical alkylene, substituted alkylene, arylene, substituted arylene, or substituted aralkylene. Alkyl includes linear and branched components with from 1 to about 25, and preferably from 1 to about 10 carbon atoms, such as methyl, ethyl, propyl, butyl, pentyl, heptyl, octyl, and decyl. Cycloalkyl includes homologous rings from cyclopropane to cyclododecane. Substituted alkyl groups contain substituents such as hydroxy, alkoxy, carboxy, cyano, dialkylamino and the like. Aryl includes components with from 6 to about 24 carbon atoms such as phenyl, naphthyl, biphenyl, terphenyl and the like. Substituted aryl groups preferably contain from about 1 to about 5 substituents such as methyl, tertiary-butyl, halogen, (fluoro, chloro, bromo, and iodo), hydroxy, alkox, like methoxy, nitro, cyano and dialkylamino like dimethylamino. Aralkyl includes components with from about 7 to about 24 carbon atoms such as benzyl, phenethyl, fluorenyl and the like. Substituted aralkyl groups can contain the same substituents aryl, for example, methyl, tertiary-butyl, halogen, hydroxy, methoxy, nitro and dialkylamino.

Unsymmetrical alkylene examples include 1,2-propylene, 1-methyl-1,3-propylene, 1-ethyl,3-propylene, 1-methy-1,4-tetramethylene, 2-methyl-1,4-tetramethylene, 1-methyl-1,5-pentamethylene, 2-methyl-1,5-pentamethylene and higher unsymmetric alkylene groups with up to about 20 carbon atoms. Examples of unsymmetric substituted alkylenes include, for example, 3-hydroxy-1,2-propylene, 2-hydroxy-1,4-tetramethylene, 2-methoxy-1,4-tetramethylene, 2-carboxy-1,4-tetramethylene and 2-dimethylamino-1,4-tetramethylene. Arylene refers, for example, to unsymmetrically substituted bridging groups such as 2,4-, 2,3'-, 2,4'-, and 3,4'-biphenylene, and 1,3-, 1,6- and 1,7-naphthylene, and substituted arylene refers, for example, to groups such as 2-chloro-1,4-phenylene, 2-methyl-4,4'-biphenylene, N-phenylbenzamide-3,4'-diyl, diphenylsulfone-3,4'-diyl and diphenylether-3,4'-diyl. Aralkylene examples are benzyl-, phenethyl-, phenylpropyl- and fluorenyl-groups in which one perylene bisimide moiety is chemically bonded to the alkyl group and the second is chemically bonded to the 2-, 3- or 4- position of the aromatic ring. Substituted aralkylene group examples include substituents such as methyl, tertiary-butyl, halogen (fluoro, chloro, bromo, and iodo), hydroxy, alkoxy like methoxy, nitro, cyano, and dialkylamine like dimethylamino, and which groups are attached to the aromatic ring, and more specifically, the phenyl ring.

FORMULA 3

Unsymmetrical Perylene Dimer With Different Terminal Substituents, Reference Copending Application U.S. Ser. No. 09/165,595, the Disclosure of Which is Totally Incorporated Herein by Reference

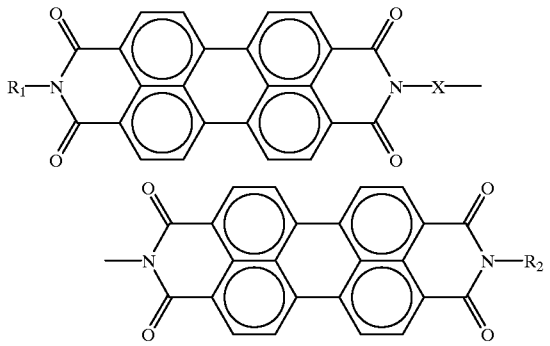

wherein $R_1$ and $R_2$ are preferably dissimilar groups such as hydrogen, alkyl, cycloalkyl, oxaalkyl, substituted alkyl, aryl, substituted aryl, aralkyl or arylalkyl, substituted aralkyl or arylalkyl, and the like, and X is as indicated herein, for example a symmetrical bridging moiety such as a single N—N bond, that is no X, or wherein X is $(X)_n$ wherein n represents the number of substituents, and more specifically, wherein X is zero or 1, and wherein X can be alkylene, substituted alkylene, cycloalkylene, arylene, substituted arylene, aralkylene, substituted aralkylene, and the like. Alkylene includes components with from 1 to about 25, and preferably from 1 to about 10 carbon atoms, such as ethylene, trimethylene, tetramethylene, pentamethylene, hexamethylene, octamethylene, dodecamethylene, and the like. Alkylene can be substituted with known effective groups such as alkyl, like methyl, alkoxy and the like. Arylene includes components with from 6 to about 24 carbon atoms such as 1,3- and 1,4-phenylene, 1,4-, 1,5-, 1,6- and 2,7-naphthylene, and the like, and which aryl can be substituted with, for example, alkyl, such as methyl, ethyl and the like. Examples of aryl and the other substituents are known and also in embodiments are as more specifically illustrated herein, but not necessarily limited to such substituents.

The individual perylenes are photoconductive and can be used to form photoconductive imaging members, however, these perylenes may possess certain disadvantages such as lower than in some instances photosensitivity, narrow spectral response range, poorer dispersion quality and the like, which disadvantages could limit their applications as imaging members. With the members of the present invention in embodiments thereof these disadvantages can be minimized, or eliminated, and increased photosensitivity can be obtainable, by selecting for the photogenerating layer a mixture of two or more perylene dimers, and more specifically wherein the perylene mixture is comprised of at least two symmetrical perylene dimers of Formula 1, and also wherein in Formula 3 the perylene is $R_1$-perylene-X-perylene-$R_1$ and $R_2$-perylene-X-perylene-$R_2$, wherein $R_1$ is dissimilar and not the same as $R_2$. The mixtures illustrated herein are generally more photosensitive than the individual components. Also, the mixtures can be composed of dimers from symmetrical (Formula 1) and unsymmetrical perylene (Formulas 2 and 3) dimers. An example of mixture is R-perylene-X-perylene-R (Formula 1) and $R_1$-perylene-X-perylene-$R_2$ (Formula 3).

Furthermore, with the perylene dimer mixtures there may be permitted larger latitudes in adjusting and designing the physical properties of the photogenerating pigment such as increasing the photosensitivity, improving the dispersion stability, broadening the spectral response range, and the like.

More specifically, the present invention relates to photoconductive imaging members containing as the photogenerating component a mixture of two or more perylene dimers which are preferably isomeric in chemical composition to each other. For example, the photogenerating mixture can be comprised of two related isomers, such as $R_1$-perylene-X-perylene-$R_1$ and $R_2$-perylene-X-perylene-$R_2$, where $R_1$ and $R_2$ are isomeric equivalents. Examples of specific mixtures are wherein, for each perylene there may be selected from about 5 to about 95, and preferably from about 25 to about 75 weight percent, and more specifically, 1,3-bis(n-pentylimidoperyleneimido)propane and its isomer 1,3-bis(2-methylbutylimidoperyleneimido)propane; and three isomeric dimers wherein $R_1$-perylene-X-perylene-$R_1$, $R_2$-perylene-X-perylene-$R_2$, and $R_1$-perylene-X-perylene-$R_2$. An example of one specific mixture contains from about 5 to about 90 weight percent for each component, and preferably about 25 to about 50 percent is 1,3-bis(n-pentylimidoperyleneimido)propane, 1,3-bis(2-methylbutylimidoperyleneimido)propane, and 1-(n-pentylimido peryleneimido)-3-(2-methylbutylimidoperyleneimido)propane.

Moreover, in embodiments the mixture of perylenes can be selected as a colorant in polymeric composite materials such as plastic features, xerographic toners, and the like. Furthermore, the perylene dimer pigments are highly colored and can be prepared with a variety of hues such as orange, red, magenta, maroon, brown, black, greenish black, and the like depending, for example, on the R- and X-structures.

Imaging members with the photogenerating pigment mixture of the present invention are sensitive to wavelengths of from about 400 to about 800 nanometers, that is throughout the visible and near infrared region of the light spectrum. Also, the imaging members of the present invention generally possess broad spectral response to white light and stable electrical properties over long cycling times as further illustrated herein.

PRIOR ART

Generally, layered photoresponsive imaging members are described in a number of U.S. Pat. Nos., such as U.S. Pat. No. 4,265,900, the disclosure of which is totally incorporated herein by reference, wherein there is illustrated a mixture comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The selection of selected perylene pigments as photoconductive substances is also known. There is thus described in Hoechst European Patent Publication 0040402, DE3019326, filed May 21, 1980, the use of N,N'-disubstituted perylene-3,4,9, 1 0-tetracarboxyldiimide pigments as photoconductive substances. Specifically, there is, for example, disclosed in this publication N,N'-bis(3-methoxypropyl)perylene-3,4, 9,10-tetracarboxyl diimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4, 9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a nonhalogenated perylene pigment photogenerating component. Both of the aforementioned patents disclose an aryl amine component as a hole transport layer.

Moreover, there are disclosed in U.S. Pat. No. 4,419,427 electrographic recording mediums with a photosemiconductive double layer comprised of a first layer containing charge carrier perylene diimide dyes, and a second layer with one or more compounds which are charge transporting materials when exposed to light, reference the disclosure in column 2, beginning at line 20.

Certain perylenes can be prepared by reacting perylene tetracarboxylic acid dianhydride with primary amines or with diamino-aryl or -alkyl compounds. Their use as photoconductors is disclosed in U.S. Pat. Nos. 3,871,882, the disclosure of which is totally incorporated herein by reference, and 3,904,407, the disclosure of which is totally incorporated herein by reference. The '882 patent discloses the use of the perylene dianhydride and bisimides in general (Formula 3a, R=H, lower alkyl (C1 to C4), aryl, substituted aryl, aralkyl, a heterocyclic group or the NHR' group in which R' is phenyl, substituted phenyl or benzoyl) as vacuum evaporated thin charge generation layers (CGLs) in photoconductive devices coated with a charge transporting layer (CTL). The '407 patent, the disclosure of which is totally incorporated herein by reference, illustrates the use of bisimide compounds (Formula 3a, R=alkyl, aryl, alkylaryl, alkoxyl or halogen, or heterocyclic substituent) with preferred pigments being R=chlorophenyl or methoxyphenyl. This patent illustrates the use of certain vacuum evaporated perylene pigment or a highly loaded dispersion of pigment in a binder resin as CGL in layered photoreceptors with a CTL overcoat or, alternatively, as a single layer device in which the perylene pigment is dispersed in a charge transporting active polymer matrix. The use of a plurality of pigments, inclusive of perylenes, in vacuum evaporated CGLs is illustrated in U.S. Pat. No. 3,992,205.

U.S. Pat. No. 4,419,427 describes the use of highly-loaded dispersions of perylene bisimides, with bis(2,6-dichlorophenylimide) being a preferred material, in binder resins as CGL layers in devices overcoated with a charge transporting layer such as a poly(vinylcarbazole) composition. U.S. Pat. No. 4,429,029 illustrates the use of bisimides and bisimidazo perylenes in which the perylene nucleus is halogenated, preferably to an extent where 45 to 75 percent of the perylene ring hydrogens have been replaced by halogen. U.S. Pat. No. 4,587,189, the disclosure of which is totally incorporated herein by reference, describes layered photoresponsive imaging members prepared using highly-loaded dispersions or, preferably, vacuum evaporated thin coatings of cis- and trans-bis(benzimidazo)perylene (1, X=1,2 phenylene) and other perylenes overcoated with hole transporting compositions comprised of a variety of N,N, N',N'-tetraaryl-4,4'-diaminobiphenyls. U.S. Pat. No. 4,937, 164 illustrates the use of perylene bisimides and bisimidazo pigments in which the 1,12- and/or 6,7 position of the perylene nucleus is bridged by one or 2 sulfur atoms wherein the pigments in the CGL (charge generating layer) layers are either vacuum evaporated or dispersed in binder resins in similar devices incorporating tetraaryl biphenyl hole transporting molecules.

Perylene pigments which are unsymmetrically substituted have also been selected as CGL (charge generating layers) materials in layered photoreceptors. The preparation and applications of these pigments, which can be either bis (imides) in which the imide nitrogen substituents are different or have monoimide-monoimidazo structures is described in U.S. Pat. Nos. 4,501,906; 4,709,029 and 4,714,666. U.S. Pat. No. 4,968,571 discloses the use of a large variety of unsymmetrically substituted perylenes with one phenethyl radical bonded to the imide nitrogen atom.

Two additional patents relating to the use of perylene pigments in layered photoreceptors are U.S. Pat. No. 5,019, 473, which illustrates a grinding process to provide finely and uniformly dispersed perylene pigment in a polymeric binder with excellent photographic speed, and U.S. Pat. No. 5,225,307, the disclosure of which is totally incorporated herein by reference, which discloses a vacuum sublimation process which provides a photoreceptor pigment, such as bis(benzimidazo)perylene (3b, X=1,2-phenylene) with superior electrophotographic performance.

The following patents, the disclosures of which are totally incorporated herein by reference, relate to the use of perylene compounds, either as dissolved dyes or as dispersions in electrophotographic photoreceptors usually based on sensitized poly(vinyl carbazole) compositions: U.S. Pat. Nos. 4,469,769; 4,514,482; 4,556,622; and Japanese JP 84-31,957, -119,356, -119,357, -140,454, -140,456, -157, 646, and -157,651.

Perylene photogenerating pigments are illustrated in U.S. Pat. Nos. 5,645,965; 5,683,842, and 5,756,744, recited hereinbefore.

Although the known imaging members may be suitable for their intended purposes, a need remains for imaging members containing improved photogenerator pigments. In addition, a need exists for imaging members containing photoconductive components with improved xerographic electrical performance including in some instances higher charge acceptance, lower dark decay, increased charge generation efficiency and charge injection into the transporting layer, tailored PIDC curve shapes to enable a variety of reprographic applications, reduced residual charge and/or reduced erase energy, improved long term cycling performance, and less variability in performance with environmental changes in temperature and relative humidity. There is also a need for imaging members with photoconductive components comprised of certain dimeric perylene photogenerating pigment mixtures with enhanced dispersibility in polymers and solvents. Moreover, there is a need for photogenerating pigments which permit the preparation of coating dispersions, particularly in dip-coating operations, which are colloidally stable and wherein settlement is avoided or minimized, for example little settling for a period of from 20 to 30 days in the absence of stirring. Further, there is a need for photoconductive materials with enhanced dispersibility in polymers and solvents that enable low cost coating processes in the manufacture of photoconductive imaging members. Most importantly, there remains a need for adjusting the physical properties of photogenerating compositions to achieve a number of desired performance requirements of photoconductors. For instance, there is a need for photoconductive materials that enable imaging members with enhanced photosensitivity in the red region of the light spectrum enabling the resulting imaging members thereof to be selected for imaging by red diode and gas lasers. Furthermore, there is a need for photogenerator pigments with spectral response in the green and blue regions of the spectrum to enable imaging by newly emerging blue and green electronic imaging light sources. A need also exists for improved panchromatic pigments with broad spectral response from about 400 to about 800 nanometers for color copying using light-lens processes.

SUMMARY OF THE INVENTION

Examples of features of the present invention include:

It is a feature of the present invention to provide perylene mixtures.

It is another feature of the present invention to provide perylene mixtures that can be selected for imaging members and visible organic nontoxic or substantially nontoxic perylene mixtures.

Additionally, in another feature of the present invention there are provided perylene bisimide dimer mixtures suitable for use as dispersed colorants in polymeric composites and as photogenerator pigments in layered photoconductive imaging devices. The perylene dimer mixture can be comprised of two or more perylene dimers and wherein each perylene bisimide dimer is comprised of two identical or different, substituted or unsubstituted perylene moieties joined together by a symmetrical or unsymmetrical bridging group.

It is another feature of the present invention to provide photoconductive imaging members with perylene dimer photogenerating pigment mixtures and that enable imaging members with improved photosensitivity in the wavelength region of light spectrum, such as from about 400 to about 800 nanometers.

These and other features of the present invention can be accomplished in embodiments by the provision of perylene mixtures that can be selected for layered imaging members comprised of a supporting substrate, a photogenerating layer comprised of the perylene mixtures comprised of a mixture of perylene bisimide dimers, such as those encompassed by Formulae 1, 2 and 3 and wherein the substituents like $R_1$, X, Y, n, are as indicated herein, and in U.S. Pat. Nos. 5,756,744, a division of U.S. Pat. No. 5,683,842, 5,645,965, and 5,683,842. More specifically, in these formulas R can be hydrogen, alkyl, oxaalkyl, aryl, arylakyl and the like, X is a single N—N bond, that is no X is present, or X is a symmetrical alkylene, cycloalkylene, arylene, or aralkylene bridging group, X-Y is an unsymmetrical bridging moiety such as unsymmetrical alkylene, unsymmetrical arylene, or unsymmetrical aralkylene.

Aspects of the present invention relate to a photoconductive imaging member comprised of a novel mixture of perylenes as a charge generator, wherein the mixture comprises at least two perylenes encompassed by the following formulas, or mixtures thereof

FORMULA 1

Symmetrical Perylenes

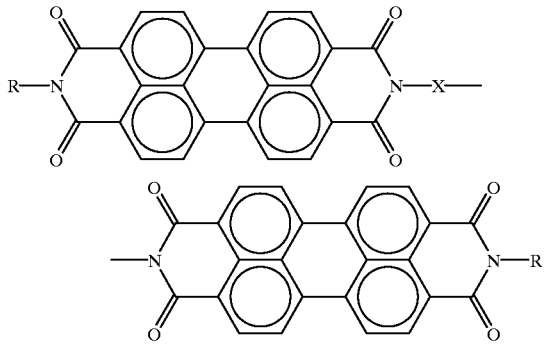

FORMULA 2

Unsymmetrical Perylenes

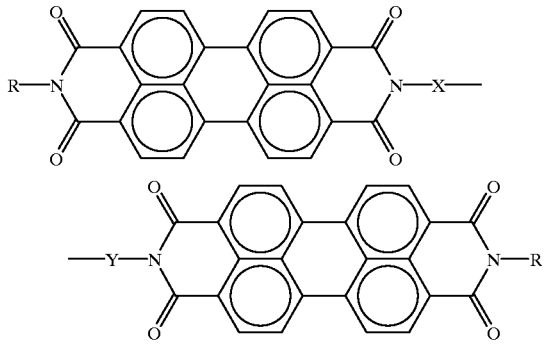

FORMULA 3

Unsymmetrical Perylenes with Different $R_1$ and $R_2$ Terminal Substituents

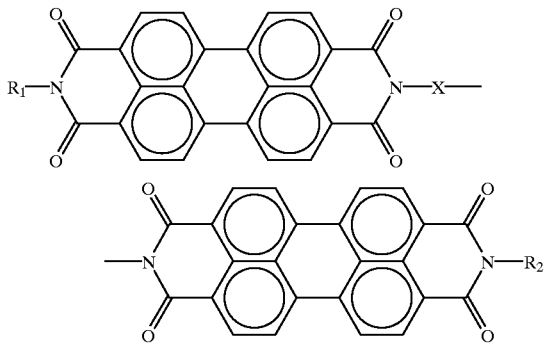

wherein R is independently hydrogen, alkyl, cycloalkyl, oxaalkyl, substituted alkyl, aryl, substituted aryl, aralkyl (or arylalkyl) or substituted aralkyl (or substituted arylalkyl); $R_1$ and $R_2$ are dissimilar components of hydrogen, alkyl, cycloalkyl, oxaalkyl, substituted alkyl, aryl, substituted aryl, arylalkyl, or substituted arylalkyl; and X is a symmetrical bridging moiety, and X-Y represents an unsymmetrical bridging moiety; a photoconductive imaging member further containing a supporting substrate, a photogenerator layer comprised of the perylene mixture and a charge transport layer; a mixture wherein the novel perylene mixture is comprised of the perylene 1,3-bis(n-pentylimidoperyleneimido)propane and the corresponding isomer 1,3-bis(2-methylbutylimidoperyleneimido)propane; a mixture wherein each perylene is present in a ratio of about 1:1; a mixture wherein the 1,3-bis(n-pentylimidoperyleneimido)propane is present in an amount of from about 5 to about 95 parts or weight percent, and the 1,3-bis(2-methylbutylimidoperyleneimido)propane is present in an amount of from about 95 to about 5 parts or weight percent, and wherein the total amount for the perylenes is 100 percent, or parts; a mixture wherein the perylene 1,3-bis(n-pentylimidoperyleneimido)propane is present in an amount of from about 40 to about 60 parts, and the 1,3-bis(2-methylbutylimido peryleneimido)propane is present in an amount of from about 60 to about 40 parts, and wherein the total amount for the perylenes is 100 percent; a mixture wherein the mixture is comprised of the perylene 1,3-bis(n-pentylimidoperyleneimido)propane, and the isomers 1,3-bis(2-methylbutylimidoperyleneimido)propane and 1-(n-pentylimido peryleneimido)-3-(2-methylbutylimidoperyleneimido)-propane; a mixture wherein each perylene is present in an amount of from about 5 to about 90 parts or weight percent, and the total thereof is about 100 weight percent; a mixture wherein each perylene is present in an amount of from about 25 to about 50 parts; a mixture wherein the perylene 1,3-bis(n-pentylimidoperyleneimido) propane is present in an amount of about 25 parts, the 1,3-bis(2-methylbutylimidoperyleneimido)propane is present in an amount of about 25 parts and the 1-(n-pentylimidoperyleneimido)-3-(2-methylbutylimido peryleneimido)-propane is present in an amount of about 50 parts and wherein the total of the parts is about 100; a mixture wherein alkyl contains from 1 to about 25 carbon atoms, aryl contains from 6 to about 24 carbon atoms, and aralkyl contains from about 7 to about 30 carbon atoms; a perylene mixture wherein alkyl is methyl, ethyl, propyl, isopropyl, butyl, isobutyl, sec-butyl, 2-methylbutyl, 3-methylbutyl, n-pentyl, 2-pentyl, 3-pentyl, neopentyl, n-hexyl, n-heptyl, n-octyl, n-nonyl or n-decyl; a perylene mixture wherein cycloalkyl is cyclopropyl, cyclobutyl, cyclohexyl, cycloheptyl, cyclooctyl or cyclododecyl; a mixture wherein oxaalkyl is 2-methoxyethyl, 3-methoxypropyl, 3-ethoxypropyl, or 4-methoxybutyl; a mixture in accordance with claim 1 wherein substituted alkyl is 2-hydroxyethyl, 3-hydroxypropyl, 4-hydroxybutyl, 5-hydroxypentyl, 6-hydroxyhexyl, carboxymethyl, 2-carboxyethyl, 3-carboxypropyl, 4-carboxybutyl, 5-carboxypentyl, or 6-carboxyhexyl; a perylene mixture wherein aryl is phenyl, 2-, 3-, or 4-phenylphenyl or 2-naphthyl; a mixture wherein substituted aryl is 2-, 3-, or 4-hydroxyphenyl, 2-, 3-, or 4-methylphenyl, 2-, 3-, or 4-tertiary-butylphenyl, 2, 3-, or 4-methoxyphenyl, 2-, 3-, or 4-halophenyl wherein halo is fluoro, chloro bromo or iodo, 2-, 3-, or 4-nitrophenyl, or 2-, 3-, or 4-dimethylaminophenyl; a perylene mixture wherein aralkyl is benzyl, phenethyl or 3-phenylpropyl; a perylene mixture wherein X in Formulas 1 and 3 is $(X)_n$ wherein n represents the number of groups; a mixture wherein X is alkylene, substituted alkylene, cycloalkylene, arylene, substituted arylene, aralkylene, or substituted aralkylene, and X-Y is alkylene, substituted alkylene, arylene, substituted arylene, aralkylene or substituted aralkylene; a mixture wherein alkylene is ethylene, 1,3-propylene, 1,4-tetramethylene, 1,5-pentamethylene, 1,6-hexamethylene, 1,7-heptamethylene, 1,8-octamethylene, 1,9-nonomethylene, 1,10-decamethylene, 1,12-dodecamethylene, 1,15-pentadecamethylene, or 1,20-eicosamethylene; a perylene mixture wherein R is hydrogen, alkyl, cycloalkyl, substituted alkyl, aryl, substituted aryl, aralkyl or a substituted aralkyl group, and X is 1,3-propylene, 2-hydroxy-1,3-propylene, 2-methoxy-1,3-propylene, 2-methyl-1,3-propylene or 2,2-dimethyl-1,3-propylene, wherein R is methyl, ethyl, n-propyl, n-butyl, n-pentyl, n-hexyl, n-heptyl, or n-octyl, and X is a single nitrogen—nitrogen bond, ethylene, 1,4-tetramethylene, 1,5-pentamethylene, 1,6-hexamethylene, 1,7-heptamethylene, 1,8-octamethylene, 1,9-nonamethylene, 1,10-decamethylene, 1,11 -undecamethylene or 1,12-dodecamethylene, wherein R is methyl, ethyl, n-propyl, n-butyl, n-pentyl, n-hexyl, n-heptyl, or n-octyl, and X is 1,3-propylene, 2-hydroxy-1,3-propylene, 2-methoxy-1,3-propylene, 2-methyl-1,3-propylene or 2,2-dimethyl-1,3-propylene, wherein R is isopropyl, isobutyl, sec-butyl, 2-methylbutyl, 3-methylbutyl, 2-(3-methyl)butyl, 2-pentyl, 3-pentyl, neopentyl or cyclopentyl, and X is 1,3-propylene, 2-hydroxy-1,3-propylene, 2-methoxy-1,3-propylene, 2-methyl-1,3-propylene or 2,2-dimethyl-1,3-propylene, or wherein R is 2-hydroxyethyl, 3-hydroxypropyl, 4-hydroxybutyl, 5-hydroxypentyl, 6-hydroxyhexyl, 2-methoxyethyl, 3-methoxypropyl, or 4-methoxybutyl, and X is 1,3-propylene, 2-hydroxy-1,3-propylene, 2-methoxy-1,3-propylene, 2-methyl-1,3-propylene or 2,2-dimethyl-1,3-propylene; a perylene mixture for use in A mixture wherein the supporting substrate is comprised of a metal, a conductive polymer, or an insulating polymer, and wherein the substrate possesses a thickness of from about 30 microns to about 300 microns and is optionally overcoated with an electrically conductive layer with a thickness of from about 0.01 micron to about 1 micron; a mixture wherein the supporting substrate is comprised of aluminum, and there is further included an overcoating top layer on the member comprised of a polymer; a perylene mixture for use in a mixture wherein the photogenerator pigment mixture is dispersed in a resinous binder in an amount of from about 5 percent to about 95 percent by weight; a perylene mixture for use in a mixture wherein the resinous binder is a polyester, a polyvinylcarbazole, a polyvinylbutyral, a polycarbonate, a polyethercarbonate, an aryl amine polymer, a styrene copolymer, or a phenoxy resin; a perylene mixture for use in a mixture wherein the charge transport layer is comprised of aryl amine molecules or aryl amine polymers; a perylene mixture for use in a mixture wherein the charge transport layer is comprised of aryl amine molecules of the formula

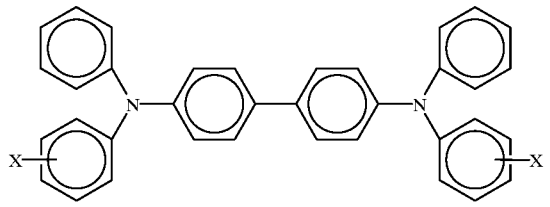

wherein X is alkyl or halogen; a perylene mixture for use in an imaging wherein the aryl amine is dispersed in a polymer of polycarbonate, a polyester, or a vinyl polymer; a perylene mixture for use in a mixture wherein the photogenerating layer is of a thickness of from about 1 to about 10 microns; a perylene mixture for use in a mixture wherein the charge transport layer is of a thickness of from about 10 to about 100 microns; a perylene mixture for use in a mixture wherein the supporting substrate is overcoated with a polymeric adhesive layer of a thickness of from about 0.01 to about 1 micron; a perylene mixture for use in a mixture wherein the charge transport layer is situated between the supporting substrate and the photogenerator layer, or the photogenerating layer is situated between the supporting substrate and the charge transport layer; a perylene mixture for use in an imaging method which comprises the formation of a latent image on the photoconductive imaging member of the present invention, transferring the image to a substrate, and optionally fixing the image thereto; a perylene mixture for use in an imaging method which comprises the formation of a latent image on the photoconductive imaging member the present invention, developing the image with a toner composition comprised of resin and colorant, transferring the image to a substrate, and optionally fixing the image thereto; a perylene mixture for use in a mixture wherein the unsymmetrical bridging moiety is alkylene, substituted alkylene, arylene, substituted arylene, aralkylene or substituted aralkylene; a perylene mixture for use in a photoconductive member wherein the mixture is comprised of (1) 1,3-bis(n-butylimidoperyleneimido)propane, and 1,3-bis(2-isobutylimido peryleneimido)propane; (2)1,3-bis(n-butylimidoperyleneimido)propane. and 1,3-bis(n-hexylimidoperyleneimido)propane; (3) 1,3-bis(n-pentylimido peryleneimido)propane and 1,5-bis(n-pentylimido peryleneimido)-2-methylpentane; (4) 1,5-bis(n-butylimidoperyleneimido)-2-methylpentane, and 1,5-bis(n-pentylimidoperyleneimido)-2-methylpentane; (5) 1,3-bis(n-propylimidoperyleneimido)propane, 1,3-bis(n-butylimido peryleneimido)propane and 1,3-bis(n-pentylimidoperyleneimido) propane; (6) 1,4-bis(n-pentylimidoperyleneimido)butane, 1,4-bis(2-methylbutylimido peryleneimido)butane and 1-(n-pentylimidoperyleneimido)-4-(2-methylbutylimido peryleneimido)butane; (7) 1,4-bis(n-pentylimidoperyleneimido) butane, 1,4-bis(2-methylbutylimidoperyleneimido)butane and 1-(n-pentylimido peryleneimido)-4-(2-methylbutylimidoperyleneimido)butane; (8) 1,3-bis(n-pentylimidoperyleneimido)propane, 1,3-bis(2-methylbutylimidoperyleneimido) propane, and 1,4-bis(n-pentylimidoperyleneimido)butane; (9) 1,3-bis(n-pentylimidoperyleneimido) propane, and its isomer 1,3-bis (2-methylbutylimidoperyleneimido)propane, 1,3-bis(n-butylimidoperyleneimido) propane and its isomer 1,3-bis (isobutylimidoperyleneimido)propane; (10) 1,3-bis(n-propylimido peryleneimido)propane, 1,3-bis(n-butylimidoperyleneimido) propane, 1,3-bis(n-pentylimidoperyleneimido)propane, and 1,3-bis(n-hexylimidoperyleneimido) propane; or (11) 1 ,3-bis(n-pentylimido peryleneimido)propane 1,3-bis(n-pentylimidoperyleneimido)propane, 1,5-bis(n-butylimidoperyleneimido)-2-methylpentane, and 1,5-bis(n-pentylimido peryleneimido)-2-methylpentane; a perylene mixture for use in a mixture wherein each component of (1) is present in an amount of from about 5 to about 95 weight percent, and the total of the components is about 100 percent; a perylene mixture for use in a mixture wherein each component of (1) is present in an amount of from about 25 to about 75 weight percent, and the total of the components is about 100 percent; a perylene mixture for use in a mixture wherein each component of (2) is present in an amount of from about 5 to about 95 weight percent, and the total of the components is about 100 percent; a perylene mixture for use in a mixture wherein each component of (2) is present in an amount of from about 25 to about 75 weight percent, and the total of the components is about 100 percent; a perylene mixture for use in a mixture wherein each component of (3) is present in an amount of from about 5 to about 90 weight percent, and the total of the components is about 100 percent; a perylene mixture for use in a mixture wherein each component of (3) is present in an amount of from about 25 to about 50 weight percent, and the total of the components is about 100 percent; a perylene mixture for use in a mixture wherein each component of (4) is present in an amount of from about 5 to about 95 weight percent, and the total of the components is about 100 percent; a perylene mixture for use in a mixture wherein each component of (4) is present in an amount of from about 15 to about 55 weight percent, and the total of the components is about 100 percent; a perylene mixture for use in a mixture wherein each component of (5) is present in an amount of from about 5 to about 95 weight percent, and the total of the components is about 100 percent; a perylene mixture for use in a mixture wherein each component of (6) is present in an amount of from about 5 to about 95 weight percent, and the total of the components is about 100 percent; a perylene mixture for use in a mixture wherein each component of (7) is present in an amount of from about 5 to about 95 weight percent, and the total of the components is about 100 percent; a perylene mixture for use in a mixture wherein each component of (8) is present in an amount of from about 5 to about 95 weight percent, and the total of the components is about 100 percent; a perylene mixture for use in a mixture wherein each component of (9) is present in an amount of from about 5 to about 95 weight percent, and the total of the components is about 100 percent; a perylene mixture for use in a mixture wherein each component of (10) is present in an amount of from about 5 to about 95 weight percent, and the total of the components is about 100 percent; a perylene mixture for use in a member wherein the mixture is comprised of at least two perylenes encompassed by Formula 1; a perylene mixture for use in a member wherein the mixture is comprised of at least two perylenes encompassed by Formula 2; a perylene mixture for use in a member wherein the mixture is comprised of at least two perylenes encompassed by Formula 3; a perylene mixture for use in a mixture wherein the mixture contains at least one perylene encompassed by Formula 1 and at least one perylene encompassed by Formula 2; a perylene mixture for use in a mixture wherein the mixture contains at least one perylene encompassed by Formula 1 and at least one perylene encompassed by Formula 3; a perylene mixture for use in a mixture wherein the mixture contains at least one perylene encompassed by Formula 2 and at least one perylene encompassed by Formula 3; a perylene mixture for use in a mixture wherein the mixture is comprised of at least two perylenes encompassed by Formula 1 and at least one perylene encompassed by Formula 2; a perylene mixture for use in a mixture wherein the mixture is comprised of at least two perylenes encompassed by Formula 1 and at least one perylene encompassed by Formula 3; a perylene mixture for use in a mixture wherein the mixture is comprised of from about 1 to about 5 perylenes encompassed by Formula 1; from about 1 to about 5 perylenes encompassed by Formula 2; and from about 1 to about 5 perylenes encompassed by Formula 3; a perylene mixture for use in a mixture wherein alkylene contains from about 2 to about 20 carbon atoms, and arylene contains from about 6 to about 24 carbon atoms; a perylene mixture for use in a photoconductive imaging member comprised of a mixture of at least two perylenes encompassed by the Formula

FORMULA 1

Symmetrical Perylenes

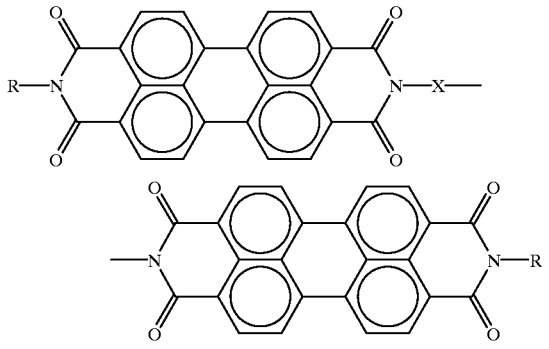

wherein R is independently hydrogen, aliphatic or aromatic; $R_1$ and $R_2$ are dissimilar; X is a symmetrical moiety and X-Y is an unsymmetrical bridging moiety; a member wherein R is hydrogen; a member wherein R is alkyl; a member wherein R is aryl; a member wherein $R_1$ is hydrogen; a member wherein $R_2$ is hydrogen; a member wherein $R_1$ and $R_2$ are alkyl or aryl; a member wherein X is alkylene; a member wherein X-Y is alkylene; a member wherein X is $(X)_n$ with n representing the number of segments; a member wherein n is zero, 1 or 2; a member wherein X is $(X)_n$ and n is zero, 1 or 2; a member wherein X is from 1 to about 5; a member wherein the two is from 2 to about 10; a perylene mixture for use in a member wherein the two is from 2 to about 5; a member further containing a charge transport layer; and a member further containing an adhesive layer, a hole blocking layer in contact with a supporting substrate.

Alkyl R groups include, methyl, ethyl, n-propyl, isopropyl, n-butyl, isobutyl, n-pentyl, 2-methylbutyl, 3-methylbutyl, neopentyl, n-hexyl, 4-methylpentyl, n-heptyl, 5-methylhexyl, and the like. Oxaalkyl R groups include 3-methoxy propyl and the like; substituted alkyl R groups include nitro or cyano alkyl like nitroethyl; aryl R groups include phenyl and substituted phenyl group such as chlorophenyl, methylphenyl, cyanophenyl and the like; arylalkyl R groups include benzyl, phenethyl, substituted benzyl such as chlorobenzyl, and substituted phenethyl such as 3-methylphenethyl, alkylene X groups include aliphatic, especially alkylene with from 2 to about 25 carbon atoms, such as ethylene, 1,3-propylene, 2-methyl-1,3-propylene, 2,2-dimethyl-1,3-propylene, 2-hydroxy-1,3-propylene, 1,4-, and 2,3-tetramethylene, 1,5- and 2,4-pentamethylene, 1,6-, 2,5- and 3,4-hexamethylene, hepta-, octa-, nona-, deca-, undeca-, dodeca-, pentadeca- and eicosa-methylene, and branched and symmetrical isomers thereof, and the like; substituted alkylene includes 2-methoxy 1,3-propylidene and the like; cycloalkylene X groups include cis- and trans-1,3-cyclobutylene, cis and trans-1,3-cyclopentylene, and cis- and trans-1,3- and 1,4-cyclohexane; arylene X groups include symmetrical aromatics such as those with from about 6 to about 24 carbon atoms such as 1,3- and 1,4-phenylene, 1,4-, 1,5-, 2,6- and 2,7-naphthylylene, 1,4-anthracenylene 4,4'-, and 3,3'-biphenylene, 4,4'-diphenylsulfone and the like; arylalkylene X groups include those moieties with from about 8 to about 30 carbon atoms such as 1,2-, 1,3- and 1,4-xylylene where the perylene moieties are bridged by connection or bonding to the methyl substituents, and the like; unsymmetrical X-Y alkylene includes 1,2-propylene, 1-methyl- 1,3-propylene, 1-ethyl-1, 3-propylene, 1-methy-1,4-tetramethylene, 2-methyl-1,4-tetramethylene, 1-methyl-1,5-pentamethylene, 2-methyl-1, 5-pentamethylene and higher unsymmetric alkylene groups with up to about 20 carbon atoms; unsymmetrical X-Y substituted alkylenes include, for example, 3-hydroxy-1,2-propylene, 2-hydroxy-1,4-tetramethylene, 2-methoxy-1,4-tetramethylene, 2-carboxy-1,4-tetramethylene and 2-dimethylamino-1,4-tetramethylene; unsymmetrically substituted bridging group examples are 2,4-, 2,3'-, 2,4'-, and 3,4'-biphenylene, and 1,3-, 1,6- and 1,7-naphthylene; unsymmetrical X-Y substituted arylenes includes groups such as 2-chloro-1,4-phenylene, 2-methyl-4,4'-biphenylene, N-phenylbenzamide-3,4'-diyl, diphenylsulfone-3,4'-diyl and diphenylether-3,4'-diyl; unsymmetrical X-Y aralkylene includes benzyl-, phenethyl-, phenylpropyl- and fluorenyl-groups in which one perylene bisimide moiety is bonded to the alkyl group and the second is bonded to the 2-, 3- or 4-position of the aromatic ring, such as, more specifically, the phenyl and unsymmetrical X-Y substituted aralkylene refers to substituents such as methyl, tertiary-butyl, halogen (i.e. fluoro, chloro, bromo, and iodo), hydroxy, methoxy, nitro, cyano and dimethylamino attached to an aromatic ring. The preferred groups for each are R=hydrogen, methyl, ethyl, n-propyl, n-butyl, isobutyl, n-pentyl, isopentyl, 2-methylbutyl, n-hexyl, 4-methylpentyl, n-heptyl, 5-methylhexyl, n-octyl, cyclopentyl, cyclohexyl, neopentyl, 3-methoxypropyl, 6-hydroxyhexyl, phenyl, benzyl, 3-chlorobenzyl, 3-chloro-4-fluorobenzyl, phenethyl, 3-methylphenethyl; for X are ethylene, 1,3-propylene, 2-methyl-1,3-propylene, 2,2-dimethyl-1,3-propylene, 1,4-tetramethylene, 1,5-pentamethyleneyl, 1,6-hexamethylene, 1,7-heptamethylene and 1,8-octamethylene, 1,4-phenylene, 4,4'-biphenylene, 1,3-xylylene, and 1,5-naphthylene; for 1-methyl-1,3-propylene, 1-methyl-1,4-tetramethylene, 2-methyl-1,5-pentamethylene, ethylbenzene-β,4-diyl, diphenylether-3,4'-diyl, and fluorenyl-6,9-diyl.

Examples of specific symmetrical perylenes of Formula 1 include those wherein R is hydrogen, methyl, ethyl, n-propyl, isopropyl, cyclopropyl, cyclopropylmethyl, n-butyl, isobutyl, sec-butyl, cyclobutyl n-pentyl, 2-pentyl, 3-pentyl, 2-(3-methyl)butyl, 2-methylbutyl, 3-methylbutyl, neopentyl, cyclopentyl, n-hexyl, 2-ethylhexyl, cyclohexyl, n-heptyl, cycloheptyl, n-octyl, cyclooctyl, n-nonyl, n-decyl, n-undecyl, n-dodecyl, phenyl, benzyl, phenethyl and substituted phenyl, benzyl and phenethyl radicals or groups in which the aromatic ring contains from 1 to 5 substituents inclusive of fluorine, chlorine, bromine, iodine, methyl, hydroxymethyl, trifluoromethyl, tertiary-butyl, tertiary-butoxy, methoxy, trifluoromethoxy, nitro, cyano, dimethylamino, diethylamino, and the like, and X is alkylene represented by 1,3-propylene; wherein R=n-propyl and X=1,3-propylene, R=n-propyl and X=4,4'-biphenyl, R=phenethyl and X=1,3-propylene, R=n-pentyl and X=1,3-propylene, R=n-butyl and X=1,3-propylene, R=isobutyl and X=1,3-propylene, R=2-methylbutyl and X=1,3-propylene, R=isopentyl and X=1,3-propylene, R=n-hexyl and X=1,3-propylene, and R=n-butyl and X=4,4'-(4",4F'"diphenoxy) phenylene, R=n-propyl and X=a N—N bond, and the like.

Examples of unsymmetrical perylenes with an unsymmetrical bridge and encompassed by Formula 2 illustrated herein include those where R is hydrogen, methyl, ethyl, n-propyl, isopropyl, 3-methoxypropyl, 3-hydroxypropyl, cyclopropyl, cyclopropylmethyl, n-butyl, iso-butyl, sec-butyl, cyclobutyl, n-pentyl, 2-pentyl, 3-pentyl, 2-(3-methyl) butyl, 2-methylbutyl, 3-methylbutyl, neopentyl, cyclopentyl, n-hexyl, 2-ethylhexyl, cyclohexyl, n-heptyl, cycloheptyl, n-octyl, cyclooctyl, n-nonyl, n-decyl, n-undecyl, n-dodecyl, cyclododecyl, phenyl, benzyl, phenethyl and substituted phenyl, benzyl and phenethyl groups in which the aromatic ring contains from 1 to 5 substituents inclusive of fluorine, chlorine, bromine, iodine, methyl, hydroxymethyl, trifluoromethyl, tertiary-butyl, tertiary-butoxy, methoxy, trifluoromethoxy, nitro, cyano, dimethylamino, diethylamino, and the like and X-Y represents an unsymmetrical bridging group, examples of such a group or groups being

EXAMPLES OF UNSYMMETRICAL X-Y BRIDGING GROUPS

X-Y = Aralkylene

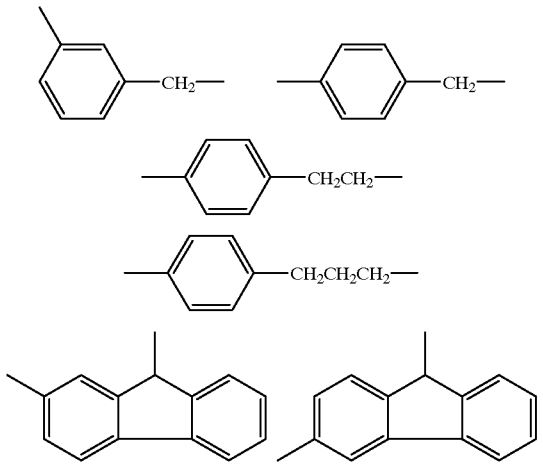

X-Y = Substituted Aralkylene

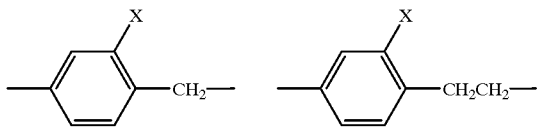

-continued

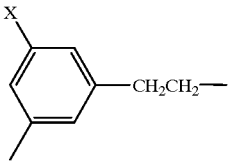

X = F, Cl, Br, OH, $CH_3$, $OCH_3$, $(CH_3)_2N$, CN, $NO_2$, etc.

Specific examples of unsymmetrical perylenes include those encompassed by Formula 2 wherein R is hydrogen, methyl, ethyl, n-propyl, allyl, 3-methoxypropyl, n-butyl, isobutyl, n-pentyl, 2-methylbutyl, 3-methylbutyl, neopentyl, n-hexyl, n-heptyl, n-octyl, phenyl, benzyl, 3-chlorobenzyl and phenethyl and X-Y is propane-1,2-diyl, butane-1,2-diyl, butane-1,3-diyl, 2-methylbutane-1,4-diyl, pentane-1,3-diyl, pentane-1,4-diyl, 2-methylpentane-1,5-diyl, toluene$\alpha$,4-diyl, and ethylbenzene-$\beta$,4-diyl and diphenyl ether-3'4'-diyl.

Examples of unsymmetrical perylenes with different terminal substituents of Formula 3 include those where R is hydrogen, methyl, ethyl, n-propyl, isopropyl, cyclopropyl, cyclopropylmethyl, n-butyl, isobutyl, sec-butyl, cyclobutyl n-pentyl, 2-pentyl, 3-pentyl, 2-(3-methyl)butyl, 2-methylbutyl, 3-methylbutyl, neopentyl, cyclopentyl, n-hexyl, 2-ethylhexyl, cyclohexyl, n-heptyl, cycloheptyl, n-octyl, cyclooctyl, n-nonyl, n-decyl, n-undecyl, n-dodecyl, phenyl, benzyl, phenethyl and substituted phenyl, benzyl and phenethyl radicals in which the aromatic ring contains from 1 to 5 substituents inclusive of fluorine, chlorine, bromine, iodine, methyl, hydroxymethyl, trifluoromethyl, tertiary-butyl, tertiary-butoxy, methoxy, trifluoromethoxy, nitro, cyano, dimethylamino, diethylamino, and the like, and X is alkylene represented by 1 ,3-propylene.

Specific examples of unsymmetrical perylenes with different terminal substituents encompassed by Formula 3 are wherein $R_1$=n-propyl, $R_2$=isopropyl and X=1,3-propylene; $R_1$ =n-butyl, $R_2$=isobutyl, and X=1,3-propylene, $R_1$=phenethyl, $R_2$=phenyl and X=1,3-propylene; $R_1$=n-pentyl, $R_2$=2-methylbutyl, and X=1,3-propylene; $R_1$=n-butyl, $R_2$=n-hexyl and X=1,3-propylene; $R_1$=n-propyl, $R_2$=isopropyl and X=4,4'-biphenyl ;$R_1$=n-pentyl, $R_2$=2-methylbutyl and X=4,4'-biphenyl; $R_1$=n-butyl, $R_2$=isobutyl and X=4,4'-biphenyl; $R_1$=n-propyl, $R_2$=isopropyl and X=a N—N bond.

Examples of specific mixtures are:

Mixture 1 comprised of two perylene dimers, 1,3-bis(n-entylimidoperyleneimido)propane, and isomer 1,3-bis(2-methylbutylimido peryleneimido)propane;

Mixture 2 comprised of two perylene dimers, 1,3-bis(n-pentylimidoperyleneimido)propane, and its isomer 1-(n-pentylimido peryleneimido)-3-(2-methylbutylimidoperyleneimido)-propane;

Mixture 3 comprised of two perylene dimers, 1,3-bis(2-methylbutylimidoperyleneimido)propane, and 1 -(n-pentylimidoperyleneimido)-3-(2-methylbutylimidoperyleneimido)-propane;

Mixture 4 comprised of three perylene dimers, 1,3-bis(n-pentylimidoperyleneimido)propane, and isomers 1,3-bis(2-methylbutylimido peryleneimido)propane and 1 -(n-pentylimidoperyleneimido)-3-(2-methylbutylimidoperyleneimido)-propane;

Mixture 5 comprised of three perylene dimers, 1,3-bis(n-propylimidoperyleneimido)propane, 1,3-bis(n-butylimidoperyleneimido)propane and 1,3-bis(n-pentylimidoperyleneimido)propane;

Mixture 6 comprised of two perylene dimers, 1,5-bis(n-butylimidoperyleneimido)-2-methylpentane, and 1,5-bis(n-pentylimido peryleneimido)-2-methylpentane;

Mixture 7 comprised of two perylene dimers, 1,3-bis(n-pentylimidoperyleneimido)propane and 1,5-bis(n-pentylimidoperyleneimido)-2-methylpentane;

Mixture 8 comprised of four perylene dimers, 1,3-bis(n-pentylimidoperyleneimido)propane, and its isomer 1,3-bis (2-methylbutylimido peryleneimido)propane, 1,3-bis(n-butylimido peryleneimido)propane and its isomer 1,3-bis (isobutylimido peryleneimido)propane;

Mixture 9 comprised of four perylene dimers, 1,3-bis(n-propylimidoperyleneimido)propane, 1,3-bis(n-butylimidoperyleneimido)propane, 1,3-bis(n-pentylimidoperyleneimido)propane, and 1,3-bis(n-hexylimido peryleneimido)propane, and other various suitable mixtures.

The amount of each component perylene in the mixture should be, for example, at least about 5 weight percent and the total percent of all of the components in the mixture is about 100 percent. For a mixture of two dimers, each is present in the amount range of from about 5 to about 95 weight percent, and preferably from about 25 to about 75 percent. For a mixture of three dimers, each is present in an amount ranging from about 5 to about 90 weight percent, and preferably about 25 to about 50 percent. For a mixture of four dimers, each is present in an amount of from about 5 to about 85 percent, and preferably about 15 to about 55 percent. The exact mixture compositions depends, for example, on the desired physical properties such as xerographic electricals, pigment dispersion characteristics and optical absorption characteristics.

Also, the composition of the mixture depends on the number of perylene components present, and the photosensitivity and spectral response range desired. Preferably the mixture contains at least about 5 weight percent of each component. Therefore, for a mixture of two different perylenes, the proportion of each component dimer can vary from about 5 to about 95 weight percent and wherein the total of the two components in the mixture is about 100 percent. For a mixture of three different dimers, each component amount can vary from about 5 to about 90 weight percent. For a specific mixture, which contains 1,3-bis(n-pentylimidoperyleneimido)propane and its isomer 1,3-bis(2-methylbutylimidoperyleneimido)propane, each component of the mixture is present in an amount of from about 5 to about 95 weight percent and preferably about 50 weight percent. Another specific perylene mixture contains three dimers: 1,3-bis(n-pentylimidoperyleneimido)propane, 1,3-bis(2-methylbutylimido peryleneimido)propane, and 1-(n-pentylimidoperyleneimido)-3-(2-methylbutylimidoperyleneimido)propane, wherein each component is present in an amount from about 5 to about 90 weight percent and preferably about 25 percent to about 50 percent. The perylene mixture contains at least two components of compound encompassed by Formulas 1, 2, and 3 illustrated herein; mixtures of compounds encompassed by Formulas 1, 2, or 3, such as a mixture of two compounds of Formula 1, a mixture of two compounds of Formulas 1 and 3; a mixture of two different compounds of Formula 2; a mixture of three different compounds of Formulas 1, 1, and 3; and other mixtures of various compounds encompassed by Formulas 1, 2, or 3; 1, 2, and 3; 1 and 2; 1 and 3; 2 and 3; and the like, and mixtures thereof.

In embodiments, the imaging members of the present invention are preferably comprised of, in the order indicated, a conductive substrate, a photogenerating layer comprising a perylene dimer pigment mixture preferably dispersed in a resinous binder composition, and a charge transport layer, which comprises charge transporting molecules preferably dispersed in an inactive resinous binder composition, and wherein the photoconductive imaging member comprises a conductive substrate, a hole transport layer comprising a hole transport composition, such as an aryl amine, dispersed in an inactive resinous binder composition, and as a top layer a photogenerating layer comprised of a perylene dimer pigment mixture, preferably two or more pigments, optionally dispersed in a resinous binder composition; or a conductive substrate, a hole blocking metal oxide layer, an optional adhesive layer, a photogenerating layer comprised of the perylene dimer pigments of the present invention, optionally dispersed in a resinous binder composition, and an aryl amine hole transport layer comprising aryl amine hole transport molecules optionally dispersed in a resinous binder.

The substrate can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects thereof. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Various suitable electrically conductive materials can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 100 Angstroms to about 750 Angstroms. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from E.I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, a polyethylene terephthalate, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers preferably situated between the substrate and subsequently applied layers may be desirable to improve adhesion and minimize or avoid peeling. When such adhesive layers are utilized, they preferably have a dry thickness of from about 0.1 micron to about 5 microns, although the thickness can be outside of this range. Typical adhesive layers include film-forming polymers such as polyester, polyvinylbutyral, polyvinylpyrrolidone, polycarbonate, polyurethane, polymethylmethacrylate, and the like and mixtures thereof. Since the surface of the substrate can be a metal oxide layer or an adhesive layer, the expression substrate is intended to also include a metal oxide layer with or without an adhesive layer on a metal oxide layer.

The photogenerating layer is of an effective thickness, for example, of from about 0.05 micron to about 10 microns or more, and in embodiments has a thickness of from about 0.1 micron to about 3 microns. The thickness of this layer can be dependent primarily upon the concentration of photogenerating material in the layer, which may generally vary from about 5 to 100 percent. The 100 percent value generally occurs when the photogenerating layer is prepared by vacuum evaporation of the pigment. When the photogenerating material is present in a binder material, the binder contains, for example, from about 25 to about 95 percent by weight of the photogenerating material, and preferably contains about 60 to about 80 percent by weight of the photogenerating material. Generally, it is desirable to provide this layer in a thickness sufficient to absorb about 90 to about 95 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274, and 5,139,910, the disclosures of each are totally incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methyl phenyl)-(1,1'-biphenyl)-4,4'-diamine, N,N'-diphenyl-N,N'-bis(2-methylphenyl)-(1,1'-biphenyl)4,4'diamine, N,N'-diphenyl-N,N'-bis(3-ethylphenyl)-(1,1'-biphenyl)-4,4'diamine, N,N'-diphenyl-N,N'-bis(4-ethylphenyl)-(1,1'-biphenyl)-4,4'diamine, N,N'-diphenyl-N,N'-bis(4-n-butylphenyl)-(1,1'-biphenyl)-4,4'-diamine, N,N'-diphenyl-N,N'-bis(3chlorophenyl)-(1,1'-biphenyl)-4,4-diamine, N,N'-diphenyl-N,N'-bis(4-chlorophenyl)-(1,1'-biphenyl)-4,4'-diamine, N,N'-diphenyl-N,N'-bis(phenylmethyl)-( 1,1'-biphenyl)4,4'-diamine, N,N,N',N'-etraphenyl-[2,2'-dimethyl-1,1'-biphenyl]-4,4'-diamine, N,N,N',N'-tetra-(4-ethylphenyl)-[2,2'-dimethyl-1,1'-biphenyl]4,4'-diamine, N,N'-diphenyl-N,N'-bis(4-methylphenyl)-[2,2'-dimethyl-1,1'-biphenyl]4,4'-diamine, N,N'-diphenyl-N,N'-bis(2-methylphenyl)-[2,2'-dimethyl-1,1'-biphenyl]4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, a preferred hole transport layer, since it enables, for example, excellent effective transport of charges, is comprised of aryldiamine components as represented, or essentially represented, by the following general formula

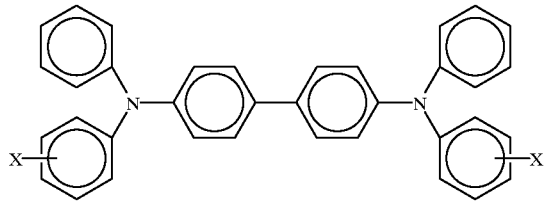

preferably dispersed in a highly insulating and transparent polymer binder, wherein X is an alkyl group, a halogen, or mixtures thereof, especially those substituents selected from the group consisting of Cl and $CH_3$, and more specifically, wherein the rings may contain X, Y and Z, with Y and Z being situated on one of the outer rings like X, are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the compound may be N,N'-diphenyl-N,N'-bis (alkylphenyl)-(1,1'-biphenyl)4,4'-diamine wherein alkyl is, for example, methyl, ethyl, propyl, n-butyl, or the like, or the compound may be N,N'-diphenyl-N,N'-bis(chlorophenyl)-(1,1'-biphenyl)-4,4'-diamine.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

The charge transport material is present in the charge transport layer in an effective amount, generally from about 5 to about 90 percent by weight, preferably from about 20 to about 75 percent by weight, and more preferably from about 30 to about 60 percent by weight, although the amount can be outside of this range.

Examples of the resinous components or inactive binder resinous material for the transport layer include materials such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 20 percent to about 75 percent of this material.

Similar binder materials may be selected for the photogenerating layer, including polyesters, polyvinyl butyrals, polyvinylcarbazole, polycarbonates, polyvinyl formals, poly (vinylacetals) and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is preferably of a thickness of equal to or less than about 50 Angstroms to about 10 microns, and most preferably being no more than about 2 microns. The photoconductive imaging member may optionally contain an adhesive interface layer as indicated herein and preferably situated between the hole blocking layer and the photogenerating layer. This layer may comprise a polymeric material such as polyester, polyvinyl butyral, polyvinyl pyrrolidone and the like. Typically, this layer is of a most preferable thickness of less than about 0.6 micron, such as from about 0.1 to about 0.5 micron.

The symmetrical perylenes of Formula 1 of the present invention can be prepared as illustrated in U.S. Pat. No. 5,645,965, the disclosure of which is totally incorporated herein by reference, and more specifically, by the reaction, or condensation of about 2 to about 5 equivalents of a perylene monoimide-monoahydride with one equivalent of a symmetrical alkylene, symmetrical cycloalkylene, symmetrical aralkylene, or symmetrical arylene diamine such as ethylene diamine, propylene diamine, 1,3-diamino-2-hydroxypropane, 1,4-diaminobutane, meta-xylylene diamine and the like, in an organic solvent, such as chloronaphthalene, trichlorobenzene, decalin, tetralin, aniline, dimethylformamide, dimethylsulfoxide, N-methylpyrrolidone and the like with the optional use of catalysts such as zinc acetate or zinc iodide in an amount equivalent to about 1 to about 50 mole percent of the perylene. The reactants are stirred in the solvent and heated to a temperature of from about 100° C. to about 300° C., preferably from about 150° C. to about 205° C. for a period of from about 10 minutes to about 8 hours depending on the rate of the reaction. The mixture is subsequently cooled to a temperature of between about 50° C. to about 175° C., and the solid pigment is preferably separated from the mother liquor by filtration through, for example, a fine porosity sintered glass filter funnel or a glass fiber filter. The pigment product is then subjected to a number of washing steps using hot and cold solvents such as dimethyl formamide, methanol, water and alcohols. Optionally, the pigment may be washed with dilute hot or cold aqueous base solution, such as 5 percent of sodium hydroxide or potassium carbonate, which serves to remove by dissolution any residual starting anhydride and other acidic contaminants. Also, optionally, the symmetrical dimeric perylene pigment product may also be washed with dilute acid, such as 2 percent aqueous hydrochloric acid, which serves to remove residual metal salts such as, for example, zinc acetate which can be optionally used as a reaction catalyst. Finally, the pigment is dried either at ambient temperature or at temperatures up to 200° C. at atmospheric pressure or under vacuum. The yield of product, referred to as as-synthesized pigment, ranges from about 50 percent to nearly 100 percent.

The unsymmetrical dimers Formula 2 can be prepared by reaction, or condensation of about 2 to about 5 equivalents of a perylene monoimide-monoahydride as illustrated in U.S. Pat. No. 5,683,842, the disclosure of which is totally incorporated herein by reference, with one equivalent of an unsymmetrical diamine such as 1,2-diaminopropane, 2-methyl-1,5-diaminopentane, 4-aminobenzylamine, 4-amino phenethylamine, 3,4'-diaminodiphenyl ether, 4,4'-diaminobenzanilide or 3,4'-diaminodiphenylsulfone in an organic solvent, such as chloronaphthalene, trichlorobenzene, decalin, tetralin, aniline, dimethylformamide, dimethylsulfoxide, N-methylpyrrolidone and the like with the optional use of catalysts such as zinc acetate or zinc iodide in an amount equivalent to about 1 to about 50 mole percent of the perylene. The concentration of reactants in the solvent can range from about 50 weight percent combined diamine and anhydride and about 50 percent solvent to about 2 percent diamine and anhydride and about 98 percent solvent with a preferred range being from about 5 percent diamine and anhydride and about 95 percent solvent to about 20 percent diamine and anhydride and about 80 percent solvent. The reactants are stirred in the solvent and heated to a temperature of from about 100° C. to about 300° C., preferably from about 150° C. to about 205° C. for a period of from about 10 minutes to about 8 hours depending on the rate of the reaction. The mixture is subsequently cooled to a temperature of between about 25° C. to about 175° C., and the solid pigment is separated from the mother liquors by filtration through, for example, a fine porosity sintered glass filter funnel or a glass fiber filter. The pigment product is then subjected to a number of washing steps using hot and cold solvents such as dimethyl formamide, methanol, water and alcohols. Optionally, the pigment may be washed with dilute hot or cold aqueous base solution such as 5 percent of sodium hydroxide or potassium carbonate which serves to remove by conversion to a water soluble salt any residual starting anhydride and other acidic contaminants. Optionally, the unsymmetrical dimeric perylene pigment product may also be washed with dilute acid such as 2 percent aqueous hydrochloric acid which serves to remove residual metal salts such as, for example zinc acetate which can be optionally used as a reaction catalyst. Finally, the pigment is dried either at ambient temperature or at temperatures up to 200° C. at atmospheric pressure or under vacuum. The yield of product, referred to as "as-synthesized pigment", ranges from about 50 percent to nearly 100 percent.

More specifically, the process comprises stirring a mixture of 2.2 molar equivalents of a perylene monoimide monoanhydride having the structure of Formula 2 in U.S. Pat. No. 5,683,842 with R=n-propyl, n-phenyl and the like in a suitable solvent, such as a N-methylpyrrolidone solvent in an amount corresponding to about 50 parts by weight of solvent to about 2 parts of monoanhydride at room temperature, about 25° C., followed by adding 1 molar equivalent of an unsymmetric diamine such as 2-methyl-1,5-diaminopentane or 4-aminobenzylamine and, optionally, a catalyst known to speed up the reaction of amine with anhydrides such as zinc acetate dihydrate in an amount corresponding to about 0.5 equivalents. Stirring the resulting mixture and heating until the solvent begins to reflux (N-methylpyrrolidone boils at 202° C.) during which treatment the diamine reacts sequentially with two molecule of the monoanhydride to form the dimeric pigment molecule. The heating and stirring at the solvent reflux temperature is maintained for a period of about 2 hours to ensure completion of the reaction, followed by cooling the reaction mixture to about 150° C. and filtering the mixture through a filter such as fine-porosity sintered glass of a glass-fiber filter which has been preheated to about 150° C. with, for example, boiling solvent such as dimethyformamide (DMF). Washing the pigment in the filter with DMF heated to about 150° C. (which serves to dissolve and thus remove any residual starting anhydride) until the color of the filtrate wash becomes, and remains, colorless or light orange. The pigment is washed with DMF at room temperature and is finally washed with acetone, methanol or a similar low-boiling solvent and is dried at 60° C. in an oven.

Optionally, water can be used in the final washing step and the pigment wet cake can be freeze dried. This process generally provides free-flowing pigment which is more readily redispersed in solvent than solvent washed pigment which has been dried using other methods which can sometimes result in the formation of a hard, caked mass of pigment which is difficult to redisperse.

Also optionally, in situations where the hot, for example about 60° C. to about 150° C., solvent (DMF) fails to completely remove all the excess starting monoanhydride from the dimer the product can be dispersed in dilute (for example 1 to about 5 percent) aqueous potassium hydroxide for a period of time of from about 1 hour to about 24 hours, and preferably from about 7 to about 20 hours, at room temperature, about 25° C. to about 90° C., which treatment converts the monoimide to a water-soluble, deep purple-colored dipotassium carboxylate salt, followed by filtration and washing the solid with water until the filtrate becomes colorless. (Residual starting anhydride in the product can be detected by known spectroscopic methods such as FT-IR and NMR or by a color spot test in which the product is stirred in dilute, ca. 2 percent) aqueous potassium hydroxide solution (the presence of monoanhydride is indicated by the development of a deep reddish purple color characteristic of the dipotassium salt of the monoimide).

Synthesis of unsymmetrical dimer with different terminal substituents as represented by Formula 3 can be prepared as illustrated in copending application U.S. Ser. No. 09/165,595, the disclosure of which is totally incorporated herein by reference, by the reaction, or condensation of, for example, about 0.5 to 2 equivalents of an aminoalkyl or aminoaryl perylene bisimide, Formula 4, (hereinafter referred to as aminobisimide) with a N-alkyl or N-aryl perylene monoimide monoanhydride (referred to as monoimide), Formula 5, in an organic solvent, such as chloronaphthalene, trichlorobenzene, decalin, tetralin, aniline, dimethylformamide, dimethylsulfoxide, N-methylpyrrolidone and the like with the optional use of appropriate catalysts, such as zinc acetate or zinc iodide, in an amount equivalent to about 1 to 50 mole percent of the perylene.

FORMULA 4

Monoaminoalkyl or Monoaminoaryl Perylene Bisimide

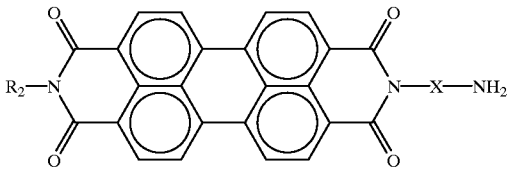

FORMULA 5

Monoimidoperylene Monoanhydride

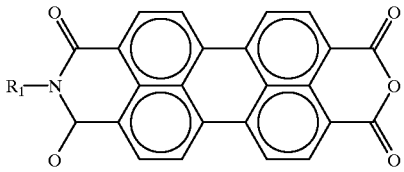

The concentration of reactants in a solvent can range from about 50 weight percent combined aminobisimide and monoimide and about 50 percent solvent to about 2 percent aminobisimide and monoimide, and 98 percent solvent with a preferred range being from about 5 percent and 95 percent solvent to 20 percent aminobisimide and monoimide and 80 percent solvent. The reactants are stirred in the solvent and heated to a temperature of from about 100° C. to about 300° C., and preferably from about 150° C. to about 205° C. for a period of, for example, from about 10 minutes to about 8 hours depending on the rate of the reaction. The mixture is subsequently cooled to a temperature of, for example, between about 25° C. to about 75° C., and the solid pigment perylene product is separated from the mother liquors by, for example, filtration through, for example, a fine porosity sintered glass filter funnel or a glass fiber filter. The perylene product may then be subjected to a number of washing steps using hot and cold solvents such as dimethyl formamide, methanol, water and alcohols. Optionally, the perylene may be washed with dilute hot or cold aqueous base solution such as a 5 percent solution of sodium hydroxide or potassium carbonate which serves to remove by conversion to a water soluble salt any residual starting monoimide and other acidic contaminants. Also, optionally the unsymmetrical dimeric perylene pigment product may also be washed with dilute acids such as 2 percent aqueous hydrochloric acid which serves to remove residual metal salts, such as for example zinc acetate which can be optionally used as a reaction catalyst. Finally, the perylene is dried either at ambient temperature or at temperatures up to 200° C. at atmospheric pressure or under vacuum. The yield of product, referred to also as "as-synthesized pigment", ranges from about 50 percent to nearly 100 percent.

More specifically, the process can comprise stirring a mixture of 1 molar equivalent of a monoimide having the structure of Formula 5 with R=n-propyl, n-phenyl and the like and 0.5 to 2 molar equivalents of an aminobisimide having the structure of Formula 4 with an R group, such as n-pentyl, benzyl and the like, which differs from that of the monoimide in N-methylpyrrolidone solvent in an amount corresponding to about 50 parts by weight of solvent to about 2 parts of monoimide at room temperature, and, optionally, adding a catalyst known to speed up the reaction of the amines with anhydrides, such as zinc acetate dihydrate, in an amount corresponding to about 0.5 equivalent. Stirring of this mixture and heating is then accomplished until the solvent begins to reflux (N-methylpyrrolidone boils at 202° C.) during which the aminobisimide reacts with the monoimide to form the dimeric perylene pigment molecule. Maintaining the heating and stirring at the solvent reflux temperature for a period of about 2 hours ensures completion of the reaction. Thereafter, cooling the reaction mixture to about 150° C. and filtering the mixture through a filter, such as fine-porosity sintered glass of a glass-fiber filter which has been preheated to about 150° C. with, for example, boiling solvent such as dimethylformamide (DMF). Washing the pigment in the filter with DMF heated to about 150° C. (which serves to dissolve and thus remove any residual starting monoimide or aminobisimide depending on which reactant was used in excess) is accomplished until the color of the filtrate wash becomes, and remains, colorless or light orange. The pigment is then washed with DMF at room temperature, about 25° C., and is finally washed with acetone, methanol or a similar low-boiling solvent and is dried at 60° C. (degrees Centigrade throughout) in an oven.

Optionally, water can be used in the final washing step and the pigment wet cake can be freeze dried. This process generally provides free flowing pigment which is more readily redispersed in solvent than solvent washed pigment which has been dried using other methods which can sometimes result in the formation of a hard, caked mass of pigment which is difficult to redisperse.

Also optionally, in situations where the hot, for example 60 to 150° C., solvent, for example DMF, fails to completely remove any excess starting monoimide from the dimer the product can be dispersed in dilute, for example about 1 to about 5 percent of aqueous potassium hydroxide for a period of time of from about 1 hour to about 24 hours, and preferably from about 7 to about 20 hours, at room temperature, about 25° C. to about 90° C., which treatment converts the monoimide to a water-soluble, deep purple-colored dipotassium carboxylate salt, followed by filtration and washing the solid with water until the filtrate becomes colorless. The residual starting anhydride in the product can be detected by known spectroscopic methods such as FT-IR and NMR, or by a color spot test in which the product is stirred in dilute, for example about 2 percent of aqueous potassium hydroxide solution with the presence of monoanhydride being indicated by the development of a deep reddish purple color characteristic of the dipotassium salt of the monoimide.

Optionally, in situations where a metal-containing catalyst, such as zinc acetate dihydrate, has been used to improve the reaction rate the product can be stirred in a dilute acid, such as 2 percent aqueous hydrochloric acid, which process converts the residual metal to water soluble salts, which can then be removed by filtration and washing with water.

A monoimide of the type illustrated in Formula 5 can be stirred at room temperature in a nonpolar organic solvent, such as heptane, octane, benzene, toluene, xylene, decalin and the like, in an amount corresponding to from about 2 parts monoimide to about 98 parts solvent to about 30 parts monoimide to about 70 parts solvent, followed by adding from about 5 molar equivalents to 100 molar equivalents of a diamine such as 1,3-diaminopropane or 1,4-phenylene diamine, stirring and heating the mixture at reflux (100° C. to 200° C. depending on the solvent) for from 1 to about 24 hours, cooling the resultant mixture to from about 25 to about 90° C., filtering to separate the product, washing the product in the filter funnel with the reaction solvent in an amount corresponding to from about 10 percent to about 100 percent of the original amount used in the reaction to remove the excess starting diamine and drying at from room temperature to about 200° C. A preferred process uses toluene (reflux temperature of about 115° C.) or xylene (reflux temperature of about 150° C.) as the reaction solvent, a reactant concentration of from about 2.5 to about 10 parts of monoimide to about 97.5 to about 90 parts of solvent, an about 5 to about 20 fold molar excess of the diamine, a reaction time of from about 2 to about 8 hours, cooling the reaction mixture to room temperature prior to filtration, washing the solid in the filter with 3 separate portions of the reaction solvent, each corresponding to about 10 percent of the original amount used in the synthesis, and drying the crude product at from room temperature to 100° C. The resultant crude aminoalkyl or aminoaryl bisimide product, which may contain both starting monoimide and the dimer formed from the condensation of 2 moles of monoimide with the same diamine molecule, i.e., the symmetrical dimer corresponding to Formula 1 wherein $R_1=R_2$, is purified to a purity of, for example, about 99 to about 99.95 percent as follows:

The crude unsymmetrical perylene product is stirred in a carboxylic acid such as formic, acetic, propionic or trifluoroacetic acid in an amount corresponding to from about 1 part crude aminobisimide to about 99 parts acid to about 25 parts aminobisimide to about 75 parts of acid at a temperature of from about 25° C. to about 140° C. (this treatment converts the aminobisimide to a soluble carboxylate salt), filtering the resultant mixture at a temperature of from about 25° C. to about 125° C. to separate any residual monoimide or dimer, both of which are essentially insoluble in the carboxylic acid, precipitation of the dissolved aminobisimide either by cooling the filtrate to room temperature or by addition of a suitable precipitant solvent, such as water, methanol, isopropanol, diethyl ether, toluene, or dichloromethane in an amount corresponding to from about 0.25 to about 5 times the volume of the filtrate, filtering and washing of the precipitated carboxlate salt of the aminobisimide with a solvent such as water, methanol, isopropanol, diethyl ether, toluene, or dichloromethane to remove the residual acid and drying the product at from room temperature to about 90° C. In the purification process, the carboxylic acid chosen and temperature used to dissolve the aminobisimide, and the precipitation method used will depend on the solubility and reactivity of the particular aminobisimide being purified.

A preferred purification solvent is acetic acid in an amount corresponding to from about 99 to about 90 parts of the crude product; at a reflux temperature of about 118° C., the preferred filtration temperature is from about 80° C. to about 115° C., the filtrate is preferably cooled to from about 25° C. to about 50° C. prior to addition of the precipitant solvent, the preferred precipitant solvent being isopropanol in an amount corresponding to from about 0.5 to about 2 parts of the original filtrate volume, the wash solvent is preferably isopropanol or methanol in an amount corresponding to about 30 to about 100 percent of the original filtrate volume and the product is preferably dried at a temperature of from about 25° C. to about 60° C.

Mixtures of symmetrical and unsymmetrical perylene dimer compounds illustrated herein in embodiments thereof enable enhanced photosensitivity in the visible wavelength range. In particular, imaging members with photosensitivity at wavelengths of from about 400 to about 800 nanometers are provided in embodiments of the present invention, which renders them particularly useful for color copying and imaging and printing applications, such as red LED and diode laser printing processes, which typically require sensitivity from about 600 to about 80 nanometers.

The present invention also encompasses a method of generating images with the photoconductive imaging members disclosed herein. The method comprises the steps of generating an electrostatic latent image on a photoconductive imaging member of the present invention, developing the latent image with a known toner comprised of resin, pigment like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. Fixing may be performed by means of any suitable method, such as flash fusing, heat fusing, pressure fusing, vapor fusing, and the like. Any material used in xerographic copiers and printers may be used as a substrate, such as paper, transparency material, or the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

SYNTHESIS EXAMPLES

The starting monoimide monoanhydrides in the following Examples were prepared by the methods described in U.S. Pat. No. 4,501,906, the disclosure of which is totally incorporated herein by reference, or by minor adaptations of the process described therein. The structures, or formulas of the product dimers were mainly established by $^{1}H$ and $^{13}C$ nuclear magnetic resonance spectrometry in trifluoroacetic acid-containing solvent mixtures. Visible absorption spectra in trifluoroacetic acid-methylene chloride solution were also measured for each product. The bisimide dimers evidence absorbence maxima at about 500 and about 540 nanometers. Trivial names, based on the substituent groups and referring to the perylene bisimide moiety as the imidoperyleneimido group, have been used. To avoid or minimize confusion and ambiguity, all compounds are also described in relation to the formulas and/or structures of Formulas 1, 2 and 3.

The synthesis Examples that follow are representative of the general synthesis and general purification processes selected.

Synthesis Example I

Preparation of 1,3-Bis-(pentylimnidoperyleneimido) propane, (Formula 1, R=n-pentyl, X=1,3-propylene)

A well-stirred dispersion of n-pentylimidoperylene monoanhydride (12.7 grams, 0.0275 mole) in 750 milliliters of NMP (N-methylpyrrolidone) in a 1 liter Erlenmeyer flask was treated or admixed with 0.927 gram (1.05 milliliters, 0.0125 mole) of 1,3-diaminopropane. The resulting mixture was then stirred at room temperature, about 25° C., for 15 minutes, then was heated to reflux. The resulting mixture initially became thick and dark brown at about 120° C., but thinned out and turned black in color as the mixture began to reflux at about 202° C. The mixture was then stirred at reflux for 3 ¼ hours, then was allowed to cool to 160° C. The mixture resulting was filtered through a preheated 15 centimeter Whatman Glass Fiber Filter (Grade GF/F) in a porcelain funnel which had been preheated with about 300 milliliters of boiling DMF. The resulting solid product was washed in the funnel with 3×150 milliliters portions of boiling DMF. The initial filtrate was dark brown; the filtrate from the final boiling DMF wash was colorless. The solid resulting was then washed with 50 milliliters of DMF, then with 3×25 milliliters portions of water. The solid was then dried at 60° C. to provide 11.1 grams of dimer as a black solid (yield=93 percent). A spot test using dilute potassium hydroxide solution showed no evidence of the starting anhydride. The dimer obtained was identified as 1,3-bis-(pentylimido peryleneimido)propane, (Formula 1, R=n-pentyl, X=1,3-propylene), or the 535-dimer.

Synthesis Example II

Preparation of 1,3-Bis-(2-methylbutylimidoperyleneimido) propane (Formula 1, R=2-methylbutyl X=1,3-propylene)

The synthesis of 1,3-bis-(2-methylbutylimidoperyleneimido) propane (Formula 1, R=2-methylbutyl, X=1,3-propylene) was accomplished in the similar manner as described in Synthesis Example I except that the monoimide monoanhydride used was 2-methylbutylimidoperylene monoanhydride. The dimer obtained was the above and is referred to as the 5'35'-dimer.

Synthesis Example III

Preparation of 1-(n-Pentylimidoperyleneimido)-3-(2-methylbutylimido peryleneimido)propane Dimer (Formula 3, $R_1$=n-pentyl, $R_2$=2-methylbutyl, X=1.3-propylene)

Part A. Synthesis of the Intermediate Aminoalkyl Bisimide, n-Pentyl-3-aminopropyl Perylene Bisimide To a suspension of n-pentylimidoperylene monoanhydride (18.44 grams, 0.04 mole) in 600 milliliters of toluene was added 29.6 grams (33.4 milliliters, 0.4 mole) of 1,3-diaminopropane. The resultant suspension was stirred and heated to reflux (about 110° C.) for 3 hours. The reaction mixture was allowed to cool to about 25° C., then was filtered. The solid resulting was washed in the filter funnel with 100 milliliters of toluene then with 3×50 milliliters portions of methanol and was dried at 60° C. to provide 20.3 grams of a dark brown solid. The crude brown solid was then stirred in 400 milliliters of glacial acetic acid and the mixture resulting was stirred and heated to reflux. The hot suspension was filtered through a preheated glass fiber filter and the solid resulting was washed with 2×100 milliliters of boiling glacial acetic acid then with 3×20 milliliters portions of methanol. The filtrate was collected and cooled to room temperature. With stirring, 500 milliliters of isopropanol were added to the filtrate to effect the precipitation of a solid compound. The solid was washed with isopropanol and dried at 60° C. to yield 18.5 grams (80 percent) of N(n-pentyl)-N'(3-aminopropyl)perylene bisimide as the acetate salt.

Part B. Condensation of the Above Aminoalkyl Bisimide with 2-methylbutyl Perylene Monoimide The above aminoalkylimide acetate salt (2.60 grams, 0.0045 mole) and 2-methylbutylimidoperylene monoanhydride (2.31 grams, 0.0050 mole) in 300 milliliters of NMP was stirred and heated to reflux (about 202° C. for 1 hour). The resultant black suspension was cooled to 150° C. then was filtered through a glass fiber filter which had been preheated with boiling DMF. The solid was washed 3×50 milliliters portions of boiling DMF then with 3×20 milliliters portions of methanol. A small amount of unreacted 2-methylbutyl imidoperylene monoanhydride was removed by dispersing the about resulting wet cake in 125 milliliters of 2 percent aqueous potassium hydroxide and stirring for 20 hours at room temperature. The dispersion was then filtered and the solid was washed with 2×100 milliliters water then boiling water until the filtrate was colorless. The solid resulting was then washed with 2×25 milliliters portions of methanol and dried at 60° C. to provide 3.7 grams (yield=86 percent) of black solid which was shown by proton magnetic resonance spectroscopy to be over 99 percent pure unsymmetrical dimer of the above titled product, there being no evidence of any detectable impurity. For simplicity, this product, Formula 3, $R_1$=n-pentyl, $R_2$=2-methylbutyl, X=1, 3-propylene, is referred to as the 535' dimer.

Synthesis Example IV

Preparation of 1,3-Bis-(n-butylimidoPeryleneimido) propane (Formula 1, R=n-butyl, X=1,3-propylene)

The synthesis of 1,3-bis-(n-butylimidoperyleneimido) propane (Formula 1, R=n-butyl, X=1,3-propylene) was accomplished in the similar manner as described in Synthesis Example I except that the monoimide monoanhydride used was n-butylimidoperylene monoanhydride. The above product is referred to as the 434-dimer.

Synthesis Example V

Preparation of 1,3-Bis(n-hexylimidoperyleneimido) propane, (Formula 1, R=n-hexyl, X=1,3-propylene), Referred to as the 636-Dimer The synthesis of 1,3-bis-(n-hexylimidoperyleneimido) propane (Formula 1, R=n-hexyl, X=1,3-propylene) was accomplished in similar manner as described in Synthesis Example I except that the monoimide monoanhydride used was n-hexylimidoperylene monoanhydride.

Synthesis Example VI

Preparation of 1,5-Bis(-butylimidoperyleneimido)-2-methylpentane (Formula 2, R=n-butyl, X-Y=2-methyl-1.5-pentamethylene)

A suspension of n-butylimidoperylene monoanhydride (2.46 grams, 0.0055 mole) in 100 milliliters of NMP was treated with 0.2905 gram (0.338 milliliter, 0.00250 mole) of 1,5-diamino-2-methylpentane (Dytek A). The mixture was stirred and was heated to reflux (202° C.) for 2 ½ hours. The resultant thick dark brown reaction mixture was cooled to 150° C. then was filtered through a 9 centimeter glass fiber filter, Whatman Grade 934AH, which had been preheated by pouring 100 milliliters of boiling dimethylformamide (DMF) solvent (boiling point 154° C.) through it. The solid product was washed in the funnel with 3×75 milliliters portions of boiling DMF. The final wash filtrate was a faint pink color. The solid was washed with 25 milliliters of cold DMF then with 2×25 milliliters of methanol and was dried at 60° C. to provide 2.25 grams (92 percent yield) of dark chocolate brown solid of the above titled compound which was a >99 percent pure dimer of Formula 2, R=n-butyl, X-Y=2-methyl-1,5-pentamethylene.

A spot test for the presence of starting monoanhydride, which was accomplished by stirring about 50 milligrams of pigment in 2 milliliters of 2 percent aqueous potassium hydroxide solution for 4 hours at room temperature, was negative, there being no sign of the deep red-purple color characteristic of the monoimide dicarboxylate salt.

Synthesis Example VII

Preparation of 1,5-Bis(n-pentylimidoperyleneimido)-2-methylpentane (Formula 2, R=n-pentyl, X-Y=2-methyl-1,5-pentamethylene)

A mixture of 2.54 grams (0.0055 mole) of n-pentylimidoperylene monoanhydride and Dytek A diamine (0.338 milliliters, 0.00250 mole) in 100 milliliters of NMP was stirred and heated at reflux (202° C.) for 2.75 hours, then was cooled to 150° C. The solid was hot filtered and washed with boiling DMF, cold DMF and methanol as in the above Example VI drying at 60° C. for 16 hours to provide 2.20 grams (88 percent yield) of a brownish red solid of the above titled product of 1,5-bis(n-pentylimidoperyleneimido)-2-methylpentane. A spot test for the presence of starting monoanhydride was negative.

DEVICE EXAMPLE 1

Xerograthic Evaluation of Perylene Bisimide Dimers and Their Mixtures

Six photoresponsive imaging members were fabricated with perylene dimer pigments obtained in Synthesis Examples I, II and III. Table A lists the compositions of pigments used to form the photogenerating layer.

TABLE A

| IMAGING MEMBER ID | COMPOSITION (IN WEIGHT PERCENT) OF PHOTOGENERATING LAYER |
|---|---|
| A | 100 percent 535-dimer pigment from Synthesis Example I |
| B | 100 percent 5'35'-dimer pigment from Synthesis Example II |
| C | 100 percent 535'-dimer pigment from Synthesis Example III |
| D | 50 percent 535-dimer and 50 percent 5'35'-dimer |
| E | 50 percent 535-dimer and 50 percent 535'-dimer |
| F | 25 percent 535-dimer, 25 percent 5'35' and 50 percent 535' |

These photoresponsive imaging members are generally known as dual layer photoreceptors containing a photogenerator layer, and thereover a charge transport layer. The photogenerator layer was prepared from a pigment dispersion as follows: 0.2 gram of the perylene dimer pigment or mixture of compositions listed in the Table A above was mixed with 0.05 gram of polyvinylbutyl (PVB) polymer, 3.5 grams of tetrahydrofuran (THF), and 3.5 grams of toluene in a 30 milliliter glass bottle containing 70 grams of ⅛-inch stainless steel balls. The bottle was placed on a roller mill, and the dispersion was milled for 4 days. Using a film applicator of 1.5 mil gap, the pigment dispersion was coated to form the photogenerator layer on a titanized MYLAR® substrate of 75 microns in thickness which had a silane layer, 0.1 micron in thickness, thereover, and E.I. DuPont 49,000 polyester adhesive thereon on the silane layer in a thickness of 0.1 micron. Thereafter, the photogenerator layer formed was allowed to dry in air for about 10 minutes. Photogenerator layers for each device were each overcoated with an amine charge transport layer prepared as follows. A transport layer solution was prepared by mixing 6.3 grams of MAKROLON®, a polycarbonate resin, 6.3 grams of N,N'-diphenyl-N,N'-bis(3-methylphenyl)-(1,1'-biphenyl)4,4'-diamine and 72 grams of methylene chloride. The solution was coated onto the above photogenerating layer using a film applicator of 10 mil gap. The resulting member was dried at 115° C. in a forced air oven for 60 minutes and the final dried thickness of transport layer was about 25 microns.

The xerographic electrical properties of each imaging member were then determined by electrostatically charging its surface with a corona discharging device until the surface potential, as measured by a capacitively coupled probe attached to an electrometer, attained an initial value $V_o$. After resting for 0.5 second in the dark, the charged member reached a surface potential of $V_{ddp}$, dark development potential, and was then exposed to light from a filtered xenon lamp. A reduction in the surface potential to $V_{bg}$, background potential due to photodischarge effect, was observed. Usually the dark decay in volt/second was calculated as $(V_o-V_{ddp})/0.5$. Usually the lower the dark decay value, the better is the ability of the member to retain its charge prior to exposure by light. Similarly, the lower the $V_{ddp}$, the poorer is the charging behavior of the member. The percent photodischarge was calculated as 100 percent× $(V_{ddp}-V_{bg})/V_{ddp}$. The light energy used to photodischarge the imaging member during the exposure step was measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller is the $E_{1/2}$ value. Higher photosensitivity (lower $E_{1/2}$ value), lower dark decay and high charging are desired for the improved performance of xerographic imaging members.

The following Table 1 summarizes the xerographic electrical results when the exposed light used was at a wavelength of 620 nanometers.

TABLE 1

| Imaging Member ID | Composition of Photogenerating Layer | Dark Decay V/s | $E_{1/2}$ Erg/cm$^2$ |
|---|---|---|---|
| A | 100 percent 535-dimer pigment from Synthesis Example I | 6.9 | 4.37 |
| B | 100 percent 5'35'-dimer pigment from Synthesis Example II | 10.4 | 6.98 |
| C | 100 percent 535'-dimer pigment from Synthesis Example III | 21.2 | 4.62 |
| D | 50 percent 535-dimer and 50 percent 5'35'-dimer | 10.4 | 3.58 |
| E | 50 percent 535-dimer and 50 percent 535'-dimer | 8.9 | 4.0 |
| F | 25 percent 535-dimer, 25 percent 5'35'-dimer and 50 percent 535'-dimer | 16.2 | 3.6 |

The imaging members (A, B and C) containing only one dimer photogenerating pigment possessed lower photosensitivity (or higher $E_{1/2}$ values) than the members (D, E and F) containing a mixture of dimers. For example, there was an improvement in the photosensitivity of 5'35' dimer (member B) by at least 40 percent when 535 alone or a mixture of 535 and 535' was added during the fabrication of photogenerating layer as shown in members D and F, respectively. Adding the least sensitive 5'35' (member B) to the most sensitive 535 (member A) can still improve the photosensitivity (i.e. reducing $E_{1/2}$ value) by 20 percent as shown by member D.

DEVICE EXAMPLE 2

Xerographic Evaluation of Perylene Bisimide Dimers and their Mixtures:

Three photoresponsive imaging members were fabricated in accordance with the procedure of device or imaging member Example 1 except that the photogenerating layers have the compositions listed in Table 2.

TABLE 2

| Imaging Member ID | Composition of Photogenerating Layer | Dark Decay V/s | $E_{1/2}$ Erg/cm$^2$ |
|---|---|---|---|
| G | 100 percent 434-dimer pigment from Synthesis Example 4 | 9.8 | 5.31 |
| H | 100 percent 636-dimer pigment from Synthesis Example 5 | 19.4 | 5.04 |
| I | 50 percent 434-dimer and 50 percent 636-dimer | 16.7 | 4.75 |

The mixture of dimers (member 1) exhibited an improvement in photosensitivity (i.e. reduced $E_{1/2}$ value) over either of its single component dimer pigments.

DEVICE EXAMPLE 3

Dependence of Photosensitivity on the Comiposition of Dimer Mixture:

Primarily to determine the influence of the composition of the dimer mixture on the xerographic performance, a series of photoresponsive imaging members incorporating different amounts of 535 and 5'35' dimers from Synthesis Examples I and II were fabricated as illustrated above. The composition of the photogenerating layer and corresponding xerographic electricals are shown in Table 3.

TABLE 3

| Imaging Member ID | Weight ratio of 535:5'35' Dimers in Photogenerating Layer | Dark Decay V/s | $E_{1/2}$ erg/cm$^2$ |
|---|---|---|---|
| J | 100:0 | 6.9 | 4.37 |
| K | 0:100 | 10.4 | 6.98 |
| L | 40:60 | 8.2 | 3.76 |
| M | 50:50 | 10.2 | 3.58 |
| N | 60:40 | 12.4 | 3.73 |

The three members L, M and N, incorporating dimer mixtures possess higher photosensitivity (lower $E_{1/2}$ value) than either 535 or 5'35'dimer. With respect to the 5'35'in device K, the dimer mixtures in devices L, M, and N showed at least a 40 percent enhancement in photosensitivity. Even with respect to the more sensitive component, i.e. 535 dimer in device J, the dimer mixtures enabled an increase the sensitivity by about 14 to 20 percent.

DEVICE EXAMPLE 4

Mixtures of Dimers with Unsymmetrical Linkages

Four perylene dimers with an unsymmetrical linkage as generally represented by Formula 2 were investigated. For dimer A, the X-Y linkage is ethylbenzene, and R is n-pentyl. For dimer B, the X-Y linkage is diphenylether, and R is n-pentyl. For dimer C, the X-Y linkage is 2-methylpentane, and R is n-butyl. For dimer D, the X-Y linkage is 2-methylpentane, and R is n-pentyl. Imaging members containing single dimers and mixtures of two dimers were fabricated in accordance with the above, and xerographically evaluated. The compositions of the photogenerating layers and corresponding xerographic electricals are shown in Table 4.

TABLE 4

| Imaging Member ID | Composition of Photogenerating Layer | Dark Decay V/s | $E_{1/2}$ Erg/cm$^2$ |
|---|---|---|---|
| O | 100 percent Dimer A Formula 2, X-Y = ethylbenzene, R = n-pentyl | 22.8 | 10.48 |
| P | 100 percent Dimer B Formula 2, X-Y = diphenylether, R = n-pentyl | 20.0 | 7.69 |
| Q | 100 percent Dimer C Formula 2, X-Y = 2-methylpentane, R = n-butyl | 9.7 | 6.13 |
| R | 100 percent Dimer D Formula 2, X-Y = 2-methylpentane, R = n-pentyl | 15.1 | 3.59 |
| S | 50 percent Dimer A and 50 percent Dimer D | 11.7 | 5.39 |
| T | 50 percent Dimer B and 50 percent Dimer D | 17 | 5.29 |
| U | 50 percent Dimer C and 50 percent Dimer D | 11.6 | 4.30 |

The results from this Table indicate that a mixture of dimers can be used to adjust the photosensitivity to the selected or preselected desired value.

Other embodiments and modifications of the present invention may occur to those skilled in the art subsequent to a review of the information presented herein; these embodiments modifications, and equivalents thereof, are also included within the scope of this invention.

What is claimed is:

1. A mixture comprised of at least two perylenes encompassed by the following formulas, or mixtures thereof

FORMULA 1

Symmetrical Perylenes

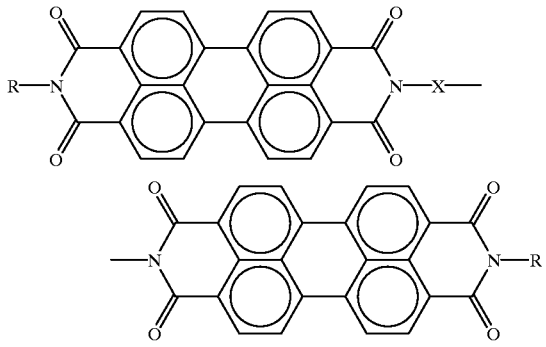

FORMULA 2

Unsymmetrical Perylenes

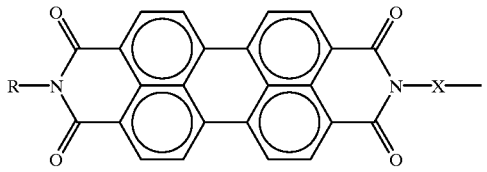

-continued

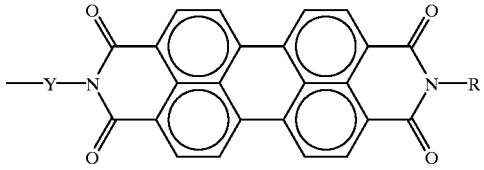

FORMULA 3

Unsymmetrical Perylenes with Different $R_1$ and $R_2$ Terminal Sustituents

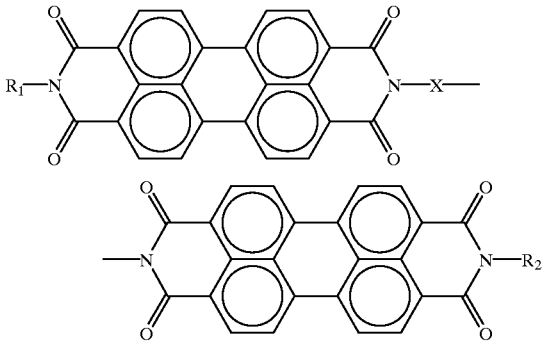

wherein R is independently hydrogen, alkyl, cycloalkyl, oxaalkyl, substituted alkyl, aryl, substituted aryl, arylalkyl or substituted arylalkyl; $R_1$ and $R_2$ are dissimilar components of hydrogen, alkyl, cycloalkyl, oxaalkyl, substituted alkyl, aryl, substituted aryl, arylalkyl, or substituted arylalkyl; and X is a symmetrical bridging moiety, and X-Y represents an unsymmetrical bridging moiety, and wherein said R represents equivalent substituents.

2. A mixture in accordance with claim 1 further containing aryl amines.

3. A mixture in accordance with claim 2 wherein the mixture is comprised of the perylene 1,3-bis(n-pentylimidoperyleneimido) propane and the corresponding isomer 1,3-bis(2-methylbutylimido peryleneimido)propane.

4. A mixture in accordance with claim 3 wherein each perylene is present in a ratio of about 1:1.

5. A mixture in accordance with claim 3 wherein the 1,3-bis(n-pentylimidoperyleneimido)propane is present in an amount of from about 5 to about 95 parts or weight percent, and the 1,3-bis(2-methylbutylimidoperyleneimido) propane is present in an amount of from about 95 to about 5 parts or weight percent, and wherein the total amount for said perylenes is 100 percent, or parts.

6. A mixture in accordance with claim 3 wherein the perylene 1,3-bis(n-pentylimidoperyleneimido)propane is present in an amount of from about 40 to about 60 parts, and the 1,3-bis(2-methylbutylimidoperyleneimido)propane is present in an amount of from about 60 to about 40 parts, and wherein the total amount for said perylenes is 100 percent.

7. A mixture in accordance with claim 1 wherein the mixture is comprised of the perylene 1,3-bis(n-pentylimido peryleneimido)propane, and the isomers 1,3-bis(2-methylbutylimido peryleneimido)propane and 1 -(n-pentylimidoperyleneimido)-3-(2-methylbutylimidoperyleneimido)-propane.

8. A mixture in accordance with claim 7 wherein each perylene is present in an amount of from about 5 to about 90 parts or weight percent, and the total thereof is about 100 percent.

9. A mixture in accordance with claim 7 wherein each perylene is present in an amount of from about 25 to about 50 parts.

10. A mixture in accordance with claim 7 wherein the perylene 1,3-bis(n-pentylimidoperyleneimido)propane is present in an amount of about 25 parts, the 1,3-bis(2-methylbutylimidoperyleneimido)propane is present in an amount of about 25 parts, and the 1-(n-pentylimidoperyleneimido)-3-(2-methylbutylimidoperyleneimido)-propane is present in an amount of about 50 parts, and wherein the total of said parts is about 100.

11. A mixture in accordance with claim 1 wherein alkyl contains from 1 to about 25 carbon atoms, aryl contains from 6 to about 24 carbon atoms, and arylalkyl contains from 7 to about 30 carbon atoms.

12. A mixture in accordance with claim 1 wherein alkyl is methyl, ethyl, propyl, isopropyl, butyl, isobutyl, sec-butyl, 2-methylbutyl, 3-methylbutyl, n-pentyl, 2-pentyl, 3-pentyl, neopentyl, n-hexyl, n-heptyl, n-octyl, n-nonyl or n-decyl.

13. A mixture in accordance with claim 1 wherein cycloalkyl is cyclopropyl, cyclobutyl, cyclohexyl, cycloheptyl, cyclooctyl or cyclododecyl.

14. A mixture in accordance with claim 1 wherein oxaalkyl is 2-methoxyethyl, 3-methoxypropyl, 3-ethoxypropyl, or 4-methoxybutyl.

15. A mixture in accordance with claim 1 wherein substituted alkyl is 2-hydroxyethyl, 3-hydroxypropyl, 4-hydroxybutyl, 5-hydroxypentyl, 6-hydroxyhexyl, carboxymethyl, 2-carboxyethyl, 3-carboxypropyl, 4-carboxybutyl, 5-carboxypentyl, or 6-carboxyhexyl.

16. A mixture in accordance with claim 1 wherein aryl is phenyl, 2-, 3-, or 4-phenylphenyl or 2-naphthyl.

17. A mixture in accordance with claim 1 wherein substituted aryl is 2-, 3-, or 4-hydroxyphenyl, 2-, 3-, or 4-methylphenyl, 2-, 3-, or 4-tertiary-butylphenyl, 2-, 3-, or 4-methoxyphenyl, 2-, 3-, or 4-halophenyl wherein halo is fluoro, chloro, bromo or iodo, 2-, 3-, or 4-nitrophenyl, or 2-, 3-, or 4-dimethylaminophenyl.

18. A mixture in accordance with claim 1 wherein arylalkyl is benzyl, phenethyl or 3-phenylpropyl.

19. A mixture in accordance with claim 1 wherein X in Formulas 1 and 3 is $(X)_n$ wherein n represents the number of groups.

20. A mixture in accordance with claim 1 wherein X is alkylene, substituted alkylene, cycloalkylene, arylene, substituted arylene, aralkylene, or substituted aralkylene, and X-Y is alkylene, substituted alkylene, arylene, substituted arylene, aralkylene or substituted aralkylene.

21. A mixture in accordance with claim 20 wherein alkylene is ethylene, 1,3-propylene, 1,4-tetramethylene, 1,5-pentamethylene, 1,6-hexamethylene, 1,7-heptamethylene, 1,8-octamethylene, 1,9-nonomethylene, 1,10-decamethylene, 1,12-dodecamethylene, 1,15-pentadecamethylene, or 1,20-eicosamethylene.

22. A mixture in accordance with claim 1 wherein R is hydrogen, alkyl, cycloalkyl, substituted alkyl, aryl, substituted aryl, arylalkyl or a substituted arylalkyl group, and X is 1,3-propylene, 2-hydroxy-1,3-propylene, 2-methoxy-1,3-propylene, 2-methyl-1,3-propylene or 2,2-dimethyl-1,3-propylene, wherein R is methyl, ethyl, n-propyl, n-butyl, n-pentyl, n-hexyl, n-heptyl, or n-octyl, and X is a single nitrogen-nitrogen bond, ethylene, 1,4-tetramethylene, 1,5-pentamethylene, 1,6-hexamethylene, 1,7-heptamethylene, 1,8-octamethylene, 1,9-nonamethylene, 1,10-decamethylene, 1,11-undecamethylene or 1,12-dodecamethylene, wherein R is methyl, ethyl, n-propyl, n-butyl, n-pentyl, n-hexyl, n-heptyl, or n-octyl, and X is 1,3-propylene, 2-hydroxy-1,3-propylene, 2-methoxy-1,3-propylene, 2-methyl-1,3-propylene or 2,2-dimethyl-1,3-propylene, wherein R is isopropyl, isobutyl, sec-butyl, 2-methylbutyl, 3-methylbutyl, 2-(3-methyl)butyl, 2-pentyl, 3-pentyl, neopentyl or cyclopentyl, and X is 1,3-propylene, 2-hydroxy-1,3-propylene, 2-methoxy-1,3-propylene, 2-methyl-1,3-propylene or 2,2-dimethyl-1,3-propylene, or wherein R is 2-hydroxyethyl, 3-hydroxypropyl, 4-hydroxybutyl, 5-hydroxypentyl, 6-hydroxyhexyl, 2-methoxyethyl, 3-methoxypropyl, or 4-methoxybutyl, and X is 1,3-propylene, 2-hydroxy-1,3-propylene, 2-methoxy-1,3-propylene, 2-methyl-1,3-propylene or 2,2-dimethyl-1,3-propylene.

23. A mixture in accordance with claim 2 wherein said aryl amines are charge transport aryl amine molecules of the formula

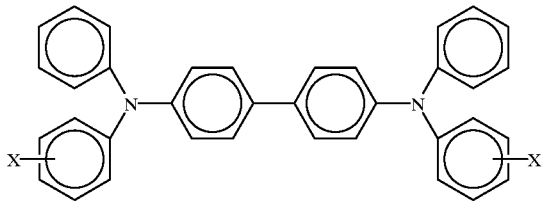

wherein X is alkyl or halogen.

24. A mixture in accordance with claim 23 wherein the aryl amine is dispersed in a polymer of a polycarbonate, a polyester, or a vinyl polymer.

25. A mixture in accordance with claim 1 wherein said unsymmetrical bridging moiety is alkylene, substituted alkylene, arylene, substituted arylene, aralkylene or substituted aralkylene.

26. A mixture in accordance with claim 1 wherein said mixture is comprised of (1) 1,3-bis(n-butylimidoperyleneimido)propane and 1,3-bis(2-isobutylimidoperyleneimido)propane; (2) 1,3-bis(n-butylimido peryleneimido)propane and 1,3-bis(n-hexylimidoperyleneimido)propane; (3) 1,3-bis(n-pentylimidoperyleneimido)propane and 1,5-bis(n-pentylimido peryleneimido)-2-methylpentane; (4) 1,5-bis(n-butylimidoperyleneimido)-2-methylpentane and 1,5-bis(n-pentylimidoperyleneimido)-2-methylpentane; (5) 1,3-bis(n-propylimidoperyleneimido)propane, 1,3-bis(n-butylimido peryleneimido)propane and 1,3-bis(n-pentylimidoperyleneimido)propane; (6) 1,4-bis(n-pentylimidoperyleneimido)butane, 1,4-bis(2-methylbutylimido peryleneimido)butane and 1-(n-pentylimidoperyleneimido)-4-(2-methylbutylimido peryleneimido)butane; (7) 1,4-bis(n-pentylimidoperyleneimido) butane, 1,4-bis(2-methylbutylimidoperyleneimido)butane and 1-(n-pentylimido peryleneimido)-4-(2-methylbutylimidoperyleneimido)butane; (8) 1,3-bis(n-pentylimidoperyleneimido)propane, 1,3-bis(2-methylbutylimidoperyleneimido) propane, and 1,4-bis(n-pentylimidoperyleneimido)butane; (9) 1,3-bis(n-pentylimidoperyleneimido) propane, and its isomer 1,3-bis (2-methylbutylimidoperyleneimido)propane, 1,3-bis(n-butylimidoperyleneimido) propane and its isomer 1,3-bis (isobutylimidoperyleneimido)propane; (10) 1,3-bis(n-propylimido peryleneimido)propane, 1,3-bis(n-butylimidoperyleneimido) propane, 1,3-bis(n-pentylimidoperyleneimido)propane, and 1,3-bis(n-hexylimidoperyleneimido) propane; or (11) 1,3-bis(n-pentylimido peryleneimido)propane 1,3-bis(n-pentylimidoperyleneimido)propane, 1,5-bis(n-butylimidoperyleneimido)-2-methylpentane, and 1,5-bis(n-pentylimidoperyleneimido)-2-methylpentane.

27. A mixture in accordance with claim 26 wherein each component of (1) is present in an amount of from about 5 to about 95 weight percent, and the total of said components is about 100 percent.

28. A mixture in accordance with claim 26 wherein each component of (1) is present in an amount of from about 25 to about 75 weight percent, and the total of said components is about 100 percent.

29. A mixture in accordance with claim 26 wherein each component of (2) is present in an amount of from about 5 to about 95 weight percent, and the total of said components is about 100 percent.

30. A mixture in accordance with claim 26 wherein each component of (2) is present in an amount of from about 25 to about 75 weight percent, and the total of said components is about 100 percent.

31. A mixture in accordance with claim 26 wherein each component of (3) is present in an amount of from about 5 to about 90 weight percent, and the total of said components is about 100 percent.

32. A mixture in accordance with claim 26 wherein each component of (3) is present in an amount of from about 25 to about 50 weight percent, and the total of said components is about 100 percent.

33. A mixture in accordance with claim 26 wherein each component of (4) is present in an amount of from about 5 to about 95 weight percent, and the total of said components is about 100 percent.

34. A mixture in accordance with claim 26 wherein each component of (4) is present in an amount of from about 15 to about 55 weight percent, and the total of said components is about 100 percent.

35. A mixture in accordance with claim 26 wherein each component of (5) is present in an amount of from about 5 to about 95 weight percent, and the total of said components is about 100 percent.

36. A mixture in accordance with claim 26 wherein each component of (6) is present in an amount of from about 5 to about 95 weight percent, and the total of said components is about 100 percent.

37. A mixture in accordance with claim 26 wherein each component of (7) is present in an amount of from about 5 to about 95 weight percent, and the total of said components is about 100 percent.

38. A mixture in accordance wvith claim 26 wherein each component of (8) is present in an amount of from about 5 to about 95 weight percent, and the total of said components is about 100 percent.

39. A mixture in accordance with claim 26 wherein each component of (9) is present in an amount of from about 5 to about 95 weight percent, and the total of said components is about 100 percent.

40. A mixture in accordance with claim 26 wherein each component of (10) is present in an amount of from about 5 to about 95 weight percent, and the total of said components is about 100 percent.

41. A mixture in accordance with claim 1 comprised of at least two perylenes encompassed by Formula 1.

42. A mixture in accordance with claim 1 comprised of at least two perylenes encompassed by Formula 2.

43. A mixture in accordance with claim 1 comprised of at least two perylenes encompassed by Formula 3.

44. A mixture in accordance with claim 1 comprised of at least one perylene encompassed by Formula 1 and at least one perylene encompassed by Formula 2.

45. A mixture in accordance with claim 1 wherein said mixture contains at least one perylene encompassed by Formula 1 and at least one perylene encompassed by Formula 3.

46. A mixture in accordance with claim 1 wherein said mixture contains at least one perylene encompassed by Formula 2 and at least one perylene encompassed by Formula 3.

47. A mixture in accordance with claim 1 wherein said mixture is comprised of at least two perylenes encompassed by Formula 1 and at least one perylene encompassed by Formula 2.

48. A mixture in accordance with claim 1 wherein said mixture is comprised of at least two perylenes encompassed by Formula 1 and at least one perylene encompassed by Formula 3.

49. A mixture in accordance with claim 1 wherein said mixture is comprised of from about 1 to about 5 perylenes encompassed by Formula 1; from about 1 to about 5 perylenes encompassed by Formula 2; and from about 1 to about 5 perylenes encompassed by Formula 3.

50. A mixture in accordance with claim 20 wherein alkylene contains from 2 to about 20 carbon atoms, and arylene contains from 6 to about 24 carbon atoms.

51. A mixture comprised of at least two perylenes encompassed by the Formulas

FORMULA 1

Symmetrical Perylenes

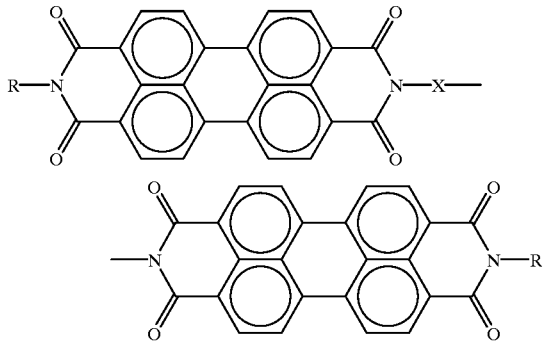

FORMULA 2

Unsymmetrical Perylenes

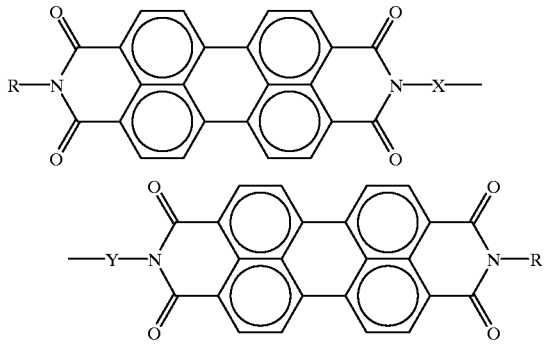

FORMULA 3

Unsymmetrical Perylenes with Different $R_1$ and $R_2$ Terminal Substituents

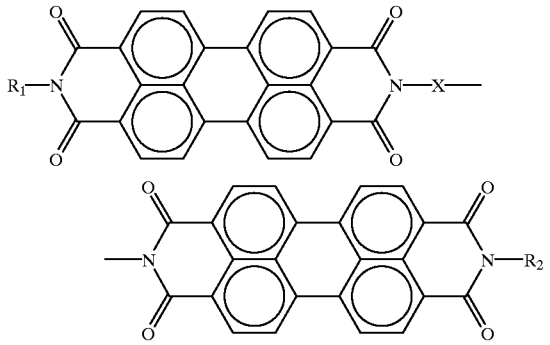

wherein R is independently hydrogen, aliphatic or aromatic; $R_1$ and $R_2$ are dissimilar; X is a symmetrical moiety and X-Y is an unsymmetrical bridging moiety, and wherein said R represents equivalent substituents.

52. A mixture in accordance with claim 51 wherein R is hydrogen.

53. A mixture in accordance with claim 51 wherein R is alkyl.

54. A mixture in accordance with claim 51 wherein R is aryl.

55. A mixture in accordance with claim 51 wherein $R_1$ is hydrogen.

56. A mixture in accordance with claim 51 wherein $R_2$ is hydrogen.

57. A mixture in accordance with claim 51 wherein $R_1$ and $R_2$ are alkyl or aryl.

58. A mixture in accordance with claim 51 wherein X is alkylene.

59. A mixture in accordance with claim 51 wherein X-Y is alkylene.

60. A mixture in accordance with claim 51 wherein X is $(X)_n$ with n representing the number of segments.

61. A mixture in accordance with claim 60 wherein n is zero, 1 or 2.

62. A mixture in accordance with claim 1 wherein X is $(X)_n$ and n is zero, 1 or 2.

63. A mixture in accordance with claim 62 wherein X is from 1 to about 5.

64. A mixture in accordance with claim 51 wherein said two is from 2 to about 10.

65. A mixture in accordance with claim 51 wherein said two is from 2 to about 5.

66. A mixture in accordance with claim 51 further containing aryl amines.

67. A mixture in accordance with claim 1 comprised of two of said perylenes.

68. A mixture in accordance with claim 51 comprised of two of said perylenes.

69. A mixture consisting essentially of at least two perylenes encompassed by the following formulas, or mixtures thereof

FORMULA 1

Symmetrical Perylenes

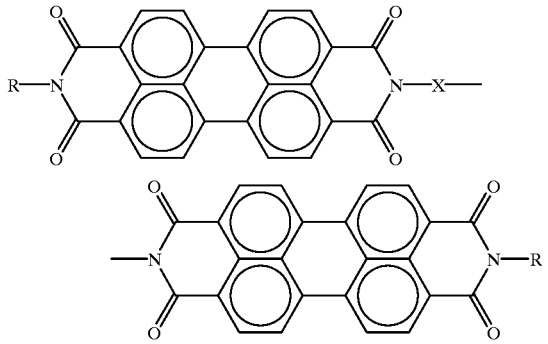

FORMULA 2

Unsymmetrical Perylenes

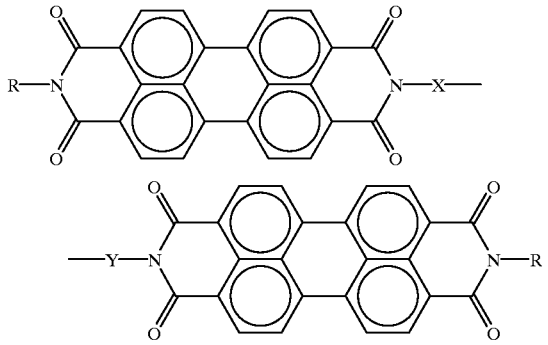

FORMULA 3

Unsymmetrical Perylenes with Different $R_1$ and $R_2$ Terminal Substituents

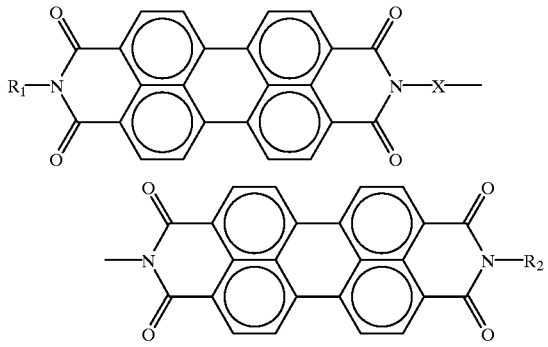

wherein R is independently hydrogen, alkyl, cycloalkyl, oxaalkyl, substituted alkyl, aryl, substituted aryl, arylalkyl or substituted arylalkyl; $R_1$ and $R_2$ are dissimilar components of hydrogen, alkyl, cycloalkyl, oxaalkyl, substituted alkyl, aryl, substituted aryl, arylalkyl, or substituted arylalkyl; and X is a symmetrical bridging moiety, and X-Y represents an unsymmetrical bridging moiety, and wherein said R, are the same substituents.

70. A mixture comprised of three perylenes as encompassed by the following formulas

FORMULA 1

Symmetrical Perylenes

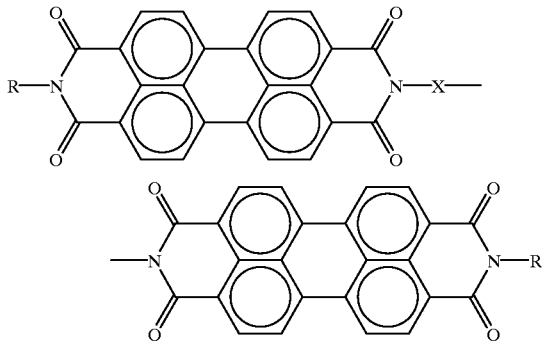

FORMULA 2

Unsymmetrical Perylenes

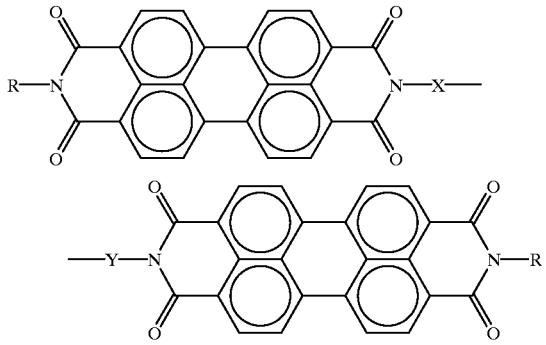

FORMULA 3

Unsymmetrical Perylenes with Different $R_1$ and $R_2$ Terminal Substituents

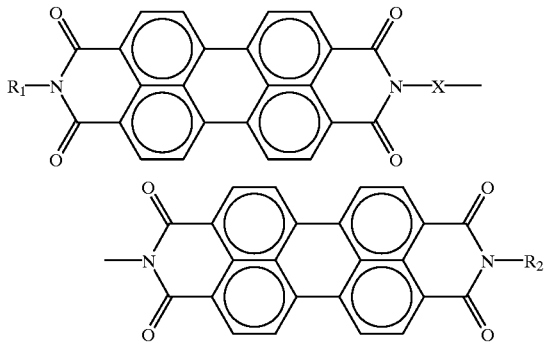

wherein R is independently hydrogen, alkyl, cycloalkyl, oxaalkyl, substituted alkyl, aryl, substituted aryl, arylalkyl or substituted arylalkyl; $R_1$ and $R_2$ are dissimilar components of hydrogen, alkyl, cycloalkyl, oxaalkyl, substituted alkyl, aryl, substituted aryl, arylalkyl, or substituted arylalkyl; and X is a symmetrical bridging moiety, and X-Y represents an unsymmetrical bridging moiety, and wherein said R, are the same substituents.

71. A mixture in accordance with claim 70 wherein said mixture is comprised of the perylene 1,3-bis(n-pentylimido peryleneimido)propane, and the isomers 1,3-bis(2-methylbutylimido peryleneimido)propane and 1 -(n-pentylimidoperyleneimido)-3-(2-methylbutylimidoperyleneimido)-propane.

72. A mixture comprised of at least two perylenes encompassed by the following formulas, or mixtures thereof

FORMULA 1

Symmetrical Perylenes

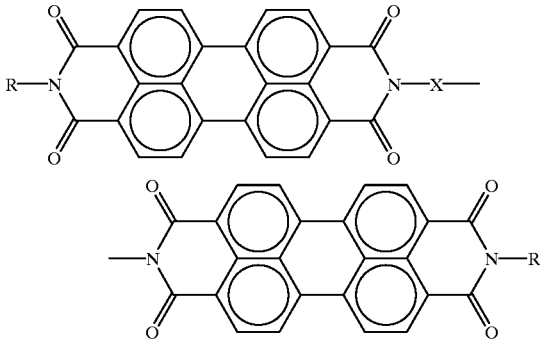

FORMULA 2

Unsymmetrical Perylenes

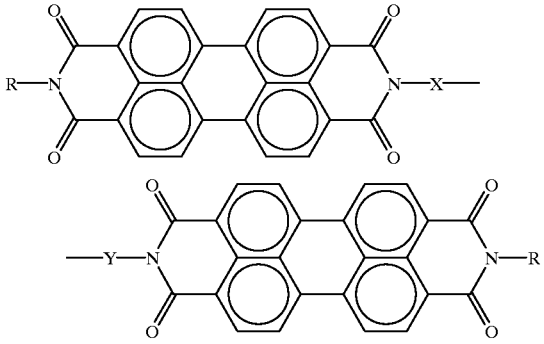

FORMULA 3

Unsymmetrical Perylenes with Different $R_1$ and $R_2$ Terminal Substituents

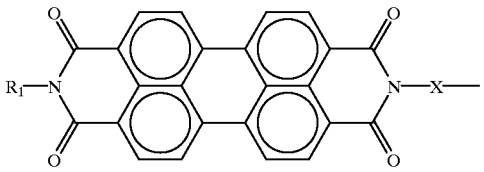

-continued

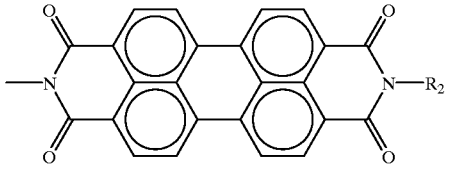

wherein R is independently hydrogen, alkyl, cycloalkyl, oxaalkyl, substituted alkyl, aryl, substituted aryl, arylalkyl or substituted arylalkyl; $R_1$ and $R_2$ are dissimilar components of hydrogen, alkyl, cycloalkyl, oxaalkyl, substituted alkyl, aryl, substituted aryl, arylalkyl, or substituted arylalkyl; and X is a symmetrical bridging moiety, and X-Y represents an unsymmetrical bridging moiety.

* * * * *